US009938038B2

(12) United States Patent
Pfeifer et al.

(10) Patent No.: US 9,938,038 B2
(45) **Date of Patent: *Apr. 10, 2018**

(54) SHIPPING AND DISPLAY CONTAINERS AND METHODS OF MAKING SAME

(71) Applicant: Menasha Corporation, Neenah, WI (US)

(72) Inventors: Mike Pfeifer, Hartford, WI (US); James L. Einstein, Winston-Salem, NC (US)

(73) Assignee: Menasha Corporation, Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/211,539

(22) Filed: Jul. 15, 2016

(65) Prior Publication Data

US 2016/0318653 A1 Nov. 3, 2016

Related U.S. Application Data

(63) Continuation-in-part of application No. 14/613,087, filed on Feb. 3, 2015, now Pat. No. 9,440,763.
(Continued)

(51) Int. Cl.
*B65D 5/52* (2006.01)
*B65D 5/50* (2006.01)
(Continued)

(52) U.S. Cl.
CPC ..... *B65D 5/5213* (2013.01); *B65D 5/4216* (2013.01); *B65D 5/4233* (2013.01);
(Continued)

(58) Field of Classification Search
CPC .... A47F 5/00; A47F 5/10; A47F 5/112; A47F 5/114; A47F 5/116; A47F 7/00;
(Continued)

(56) References Cited

U.S. PATENT DOCUMENTS 1,988,280 A * 1/1935 Levkoff ..... B65D 5/5253 206/748
2,706,037 A 4/1955 Feigelman
(Continued)

*Primary Examiner* — Bryon Gehman
(74) *Attorney, Agent, or Firm* — Greensfelder, Hemker & Gale, P.C.

(57) ABSTRACT

A shipping and display container includes, for example, a first tray element and a second tray element, each tray element having a tray element bottom panel and a tray element back panel, a bridge element disposed between the first and second tray elements, the bridge element having a first center panel and a second center panel. The first and second center panels are accordion-foldable between a first position confronting one another and a second position extending in a common plane. The shipping and display container further includes a cover element for covering a space between the first and second tray elements. The first tray element, the second tray element, the bridge element and the cover element are interconnected as a single unit, and no adhesive materials are required for assembling the container, and wherein all of the elements are integrally formed in a single blank or sheet.

16 Claims, 21 Drawing Sheets

Related U.S. Application Data

(60) Provisional application No. 61/982,077, filed on Apr. 21, 2014, provisional application No. 61/944,365, filed on Feb. 25, 2014, provisional application No. 61/936,077, filed on Feb. 5, 2014.

(51) Int. Cl.
*B65D 5/42* (2006.01)
*B65D 5/49* (2006.01)

(52) U.S. Cl.
CPC ..... *B65D 5/48024* (2013.01); *B65D 5/5035* (2013.01); *B65D 5/5038* (2013.01); *B65D 5/5246* (2013.01); *B65D 2301/10* (2013.01)

(58) Field of Classification Search
CPC .. B31B 3/14; B31B 3/26; B31B 17/00; B31B 2217/103; B65D 5/42; B65D 5/4216; B65D 5/4233; B65D 5/48; B65D 5/48022; B65D 5/48024; B65D 5/50; B65D 5/5035; B65D 5/5038; B65D 5/52; B65D 5/5213; B65D 5/5246; B65D 5/5253; B65D 5/5475; B65D 5/5495; B65D 5/68
USPC ..... 206/745–750, 767; 211/72, 85.8, 126.14, 211/126.16, 183, 189, 195; 229/120.01, 229/120.11, 120.012; 248/174
See application file for complete search history.

(56) References Cited

U.S. PATENT DOCUMENTS

| | | | | |
|---|---|---|---|---|
| 4,138,012 | A | 2/1979 | Dutcher | |
| 4,488,652 | A | 12/1984 | Hinton et al. | |
| 6,382,433 | B1 | 5/2002 | Podergois | |
| 6,676,012 | B1 * | 1/2004 | Southwell | B65D 5/002 229/120.17 |
| 7,083,048 | B2 * | 8/2006 | Taylor | B65D 5/52 206/745 |
| 7,273,149 | B2 * | 9/2007 | Lutes | B65D 5/5246 206/767 |
| 7,886,465 | B2 | 2/2011 | Virvo | |
| 8,091,715 | B2 | 1/2012 | Roth | |
| 9,227,751 | B2 * | 1/2016 | Scrimger | B65D 5/48022 |
| 9,290,288 | B1 | 3/2016 | Ikeno et al. | |
| 9,440,763 | B1 | 9/2016 | Einstein | |
| 2010/0108623 | A1 | 5/2010 | Virvo | |
| 2011/0259947 | A1 | 10/2011 | Brittain | |

* cited by examiner

SHIPPING AND DISPLAY CONTAINERS AND METHODS OF MAKING SAME

PRIORITY APPLICATION

This application claims priority to U.S. Provisional Application No. 61/936,077 filed Feb. 5, 2014, entitled "Universal PDQ Display Systems and Methods", U.S. Provisional Application No. 61/944,365 filed Feb. 25, 2014, entitled "Universal PDQ Display Systems and Methods", U.S. Provisional Application No. 61/982,077 filed Apr. 21, 2014, entitled "Universal PDQ Display Systems and Methods"; and is a continuation-in-part of U.S. application Ser. No. 14/613,087, filed Feb. 3, 2015, entitled "Shipping and Display Containers and Methods of Making Same;" each of which is incorporated herein by this reference.

FIELD OF THE INVENTION

The present invention relates generally to point-of-purchase displays and more specifically to pre-packed or pre-loaded shipping and point-of-purchase display containers.

BACKGROUND OF THE INVENTION

For many years corrugated pre-packed paperboard point of purchase displays, sometimes referred to as shelf-ready packaging (SPR) or retail-ready packaging (RRP), have been one of the mainstays of the in-store marketing mix of tools available to brand marketers. In the past, a particular version of pre-packed displays, referred to as PDQ packaging, has become a display of choice for retailers. The process for designing, manufacturing, setting up and loading the product and distributing PDQ packages has remained virtually the same since its inception many years ago. The process consists generally of a display vendor obtaining a design brief from a brand marketer or an advertising or promotional agency representing the brand marketer. The display vendor may then create a design solution based on parameters within the design brief. The initial design concept(s) may be presented to the brand marketer in several formats, such as a sketch, a rendering, a prototype or a combination of these design outputs.

In a current PDQ packaging approach, cost estimates may be provided during the design process. If a design concept is accepted and approved by a brand marketer or its agency, the display vendor may create a final prototype for approval. Once approved, final costs may be determined and the display vendor may tool up to produce the PDQ packaging. Component layouts may be provided to whomever the brand marketer has selected to create the graphics to be printed on the display. The in-store execution date and the required quantity of the brand marketer may dictate a production and fulfillment schedule. The display vendor may manufacture in-house or outsource the display components needed for the promotion. The components may then be transferred in knocked-down format to a secondary packaging operation.

Currently, a PDQ secondary packaging operation may be included in services offered by a display vendor or may be offered by a separate vendor dictated by a brand marketer. Products of the brand marketer to be sold using existing PDQ packaging may be transferred, for example, to a secondary packaging operation. Currently, product requirements may typically be transferred in an open stock shipping container which the brand marketer may use for open stock (non-display) shipments to various retailers.

Presently, both the brand marketer's product and the PDQ packaging components are at a secondary packaging operation ready to be assembled. Typically, the packing operation may build an existing PDQ package based on drawings and assembly instructions from the display vendor. The packing operation may remove the product from the open stock shipping cases and load the product into the PDQ packaging based on a planogram. The open stock cases in which the product was delivered may be disposed of by the secondary packaging operation. This process may take days or weeks depending on the size of the order and/or the availability of the product transferred to the secondary packaging operation from the brand marketer's distribution center. The pack-out of PDQ packaging may typically require some degree of protective packaging to insure the display will arrive at the retailer undamaged.

Thereafter, pre-packed PDQ packages may be loaded into a shipping case that is then palletized (x number of cases to a pallet). In most cases, the pallets of PDQ packages may then be returned to the brand marketer's distribution center. The distribution center may normally ship such pallet loads to the retailer's distribution center. The retailer's distribution center may break down such pallets and ship single or multiple PDQ packages to a receiving area of an individual store. Thereafter, store personnel may pull single or multiple PDQ packages from the receiving area and remove them from the shipping container. Store personnel may then remove protective packaging, adjust the shelves on fixtures if necessary, and place the PDQ packages on the shelves. The retail store personnel may then place the shipping container and the protective packaging into a recycling process.

Typically, the shelves at a retailer's store may be located on a four-way fixture or at an end of an aisle end-cap. Currently, in-store compliance for successfully executing existing PDQ packages among various retailers is said to be between 50% and 80%. The PDQ packages may typically remain in a store for 2-4 weeks. After that time, a retailer may break the PDQ packages down and place the components of broken down packages into a recycling process. If the PDQ packages are not completely sold out, unsold product may generally be placed with other open stock product on in-line shelves.

The current process that has been described has been the method of choice for developing and executing promotional PDQ packaging for many years but has significant deficiencies in terms of component manufacturing and supply chain efficiency. There is a current need for improvements and innovations, such as a universal display design which incorporates superior efficiencies in both component manufacturing and supply chain. Typically, current PDQ packages are manufactured to specific shelf sizes. Embodiments of the invention conform to multiple shelf sizes while maintaining full product visibility and shopability.

SUMMARY OF THE INVENTION

Embodiments of the invention provide shipping and display containers comprising, for example, first and second tray elements, each tray element having a tray element bottom panel and a tray element back panel, and each tray element back panel having portions defining a sleeve; a bridge element disposed between the first and second tray elements, the bridge element being movable between accordion-folded and extended positions of the bridge element; and a header card element having a back panel with a first portion received in the sleeve defined by portions of the first tray element back panel and a second portion received in the sleeve defined by portions of the second tray element back panel.

In aspects of embodiments of the invention, each tray element back panel portion defining the sleeve may include, for example, first and second portions of each tray element back panel confronting one another and defining the sleeve between the confronting first and second tray element back panel portions. In other aspects, the confronting first and second tray element back panel portions may further include, for example, the first and second portions of each tray element back panel folded to a position confronting one another and defining the sleeve between the confronting first and second tray element back panel portions.

In additional aspects of embodiments of the invention, the bridge element may further include, for example, first and second center panels movable between the accordion-folded and extended positions. In further aspects, the first center panel may have, for example, a flap secured to the first tray element, and the second center panel may have, for example, a flap secured to the second tray element. In still further aspects, the first and second center panels of the bridge element may be, for example, accordion-foldable between a first position confronting one another and a second position extending in a common plane. In other aspects, the flap of the first center panel may be, for example, secured to the bottom panel of the first tray element, and the flap of the second center panel being secured to the bottom panel of the second tray element. In still other aspects, the flap of the first center panel may be, for example, secured to the bottom panel of the first tray element by an adhesive material, and the flap of the second center panel may be, for example, secured to the bottom panel of the second tray element by an adhesive material.

In further aspects of embodiments of the invention, the first portion of the header card element may be, for example, received in the sleeve defined between two confronting portions of the first tray element back panel, and the second portion of header card element may be, for example, received in the sleeve defined between the two confronting portions of the second tray element back panel. In additional aspects, the first portion of the header card element may, for example, be secured in the sleeve defined between two confronting portions of the first tray element back panel, and the second portion of header card element may be, for example, slideable in the sleeve defined between the two confronting portions of the second tray element back panel. In other aspects, the first portion of the header card element may comprise, for example, a folded portion of the header card element, and the second portion of the header card element may comprise, for example, a single limb of the folded portion of the header card element.

In other aspects of embodiments of the invention, the bridge element may be, for example, movable between the accordion-folded position of the bridge element with the first and second tray elements proximate one another and the extended position of the bridge element with the first and second tray elements spaced apart from one another. In still other aspects, the bridge element may be, for example, movable between the accordion-folded position of the bridge element with the first and second tray elements proximate one another and the extended position of the bridge element with the first and second tray elements spaced apart from one another by a distance corresponding to a width of the bridge element in the extended position of the bridge element.

In still other aspects of embodiments of the invention, the header card element may further include, for example, a cover portion disposed parallel with the bottom panel of at least one of the first and second tray elements in the accordion-folded position of the bridge element with the first and second tray elements proximate one another. In still further aspects, the header card element may further include, for example, a cover portion disposed at an acute angle relative to the bridge element in the extended position of the bridge element with the first and second center panels of the bridge element extending in a common plane and the first and second tray elements spaced apart from one another by the distance corresponding to a width of the bridge element.

In further aspects of embodiments of the invention, a shipping and display container comprise a first tray element and a second tray element. Each tray element has a tray element bottom panel and a tray element back panel. The shipping and display container also comprising a bridge element disposed between the first and second tray elements. The bridge element comprises a first center panel and a second center panel which are accordion-foldable between a first position confronting one another and a second position extending in a common plane. The shipping and display container further comprising a cover element for covering a space between the first and second tray elements.

In yet further aspects of embodiments of the invention, a method for making a shipping and display container comprises providing a single sheet of material, and cutting the single sheet of material to include: a first tray element and a second tray element, a bridge element disposed between the first and second tray elements, and a cover element for covering a space between the first and second tray elements. The bridge element has a first center panel and a second center panel that are accordion-foldable between a first position confronting one another and a second position extending in a common plane, and each tray element has a tray element bottom panel and a tray element back panel. Moreover, the first tray element, the second tray element, the bridge element and the cover element include foldable portions, and wherein the first try element, the second tray element, the bridge element and the cover element are included in the single sheet of material as interconnected pieces that form a single-unit shipping and display container.

These and other aspects of the invention will be set forth in part in the description which follows and in part will become more apparent to those skilled in the art upon examination of the following or may be learned from practice of the invention. It is intended that all such aspects are to be included within this description, are to be within the scope of the present invention, and are to be protected by the accompanying claims.

DETAILED DESCRIPTION

Figure 1A:
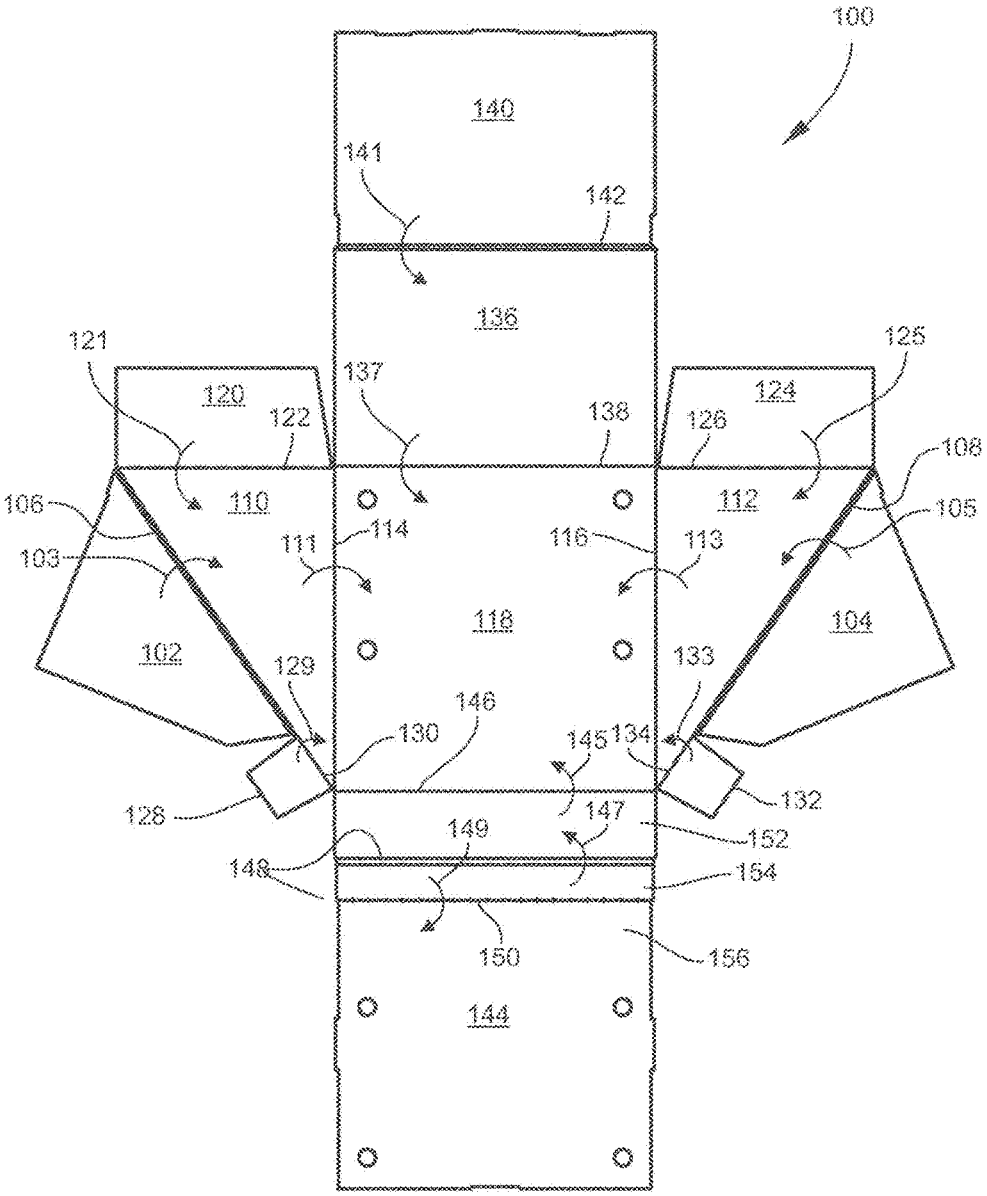
FIG. 1A is a plan view of an example of a blank of sheet material for forming a tray element for a shipping and display container for embodiments of the invention.

Reference will now be made in detail to embodiments of the invention, one or more examples of which are illustrated in the accompanying attachments. Each example is provided by way of explanation of the invention, not as a limitation of the invention. It will be apparent to those skilled in the art that various modifications and variations can be made in the present invention without departing from the scope or spirit of the invention. For example, features illustrated or described as part of one embodiment can be used in another embodiment to yield a still further embodiment. Thus, it is intended that the present invention cover such modifications and variations that come within the scope of the invention.

The universal shipping and display container for embodiments of the invention may provide designs that significantly reduce the number of display components and may be easily customized to a wide variety of product sizes, product shapes, and product counts. Embodiments of the invention may also provide significant space for brand messaging, which can easily be executed, for example, as a static sign or an animated sign. Multiple brand marketers may be enabled by embodiments of the invention to take advantage of standardized designs that may result in greater consistency at retail stores. Additionally, embodiments of the invention may streamline a design process by rapidly determining requirements, for example, for customization of a design platform to handle various product shapes, sizes, and counts. Further, embodiments of the invention may eliminate a need to tool up on each project by creating a library of standard structural designs for a variety of brand marketers.

A universal pre-packed or pre-loaded shipping and display container for embodiments of the invention provides a unique design that may include components which can be adapted to a wide variety of product shapes, sizes, and counts. Further, all of the universal pre-packed shipping and display container components for embodiments of the invention may, for example, be nested onto one cutting die form, which may generate significant efficiencies in printing and die cutting of components. In addition, the universal pre-packed shipping and display container for embodiments of the invention may include uniquely designed product tray elements with snap-in product organizer and divider elements, a uniquely designed graphic header card element, which may be joined between product tray elements, and a bridge element that may connect the joined tray elements.

In embodiments of the invention, the tray element design may include, for example, pre-glued side panel elements, a sloping front lip element, and a solid two-ply bottom element. The pre-glued side panel elements may serve to enable the rapid forming of a tray member for embodiments of the invention, and the sloping front lip may allow an advertiser to better communicate with shoppers, because advertisements appearing on such sloping front lip are more visible those appearing on a 90-degree lip. In addition, a two-ply bottom feature of the tray elements may create a uniform surface upon which to set products for display. Further, the snap-in product organizer and divider elements may decrease the amount of labor required to form the tray elements.

Pre-packed or pre-loaded shipping and display containers for embodiments of the invention provide a way to change the current complexity of the supply chain and provide an alternative approach that significantly simplifies designing, manufacturing, and executing shipping and display by consumer products goods (CPG) companies. Rather than focusing on attempting to reduce the current complexity of the supply chain, pre-packed or pre-loaded shipping and display containers for embodiments of the invention dramatically improve the current supply chain by significantly reducing the physical size of a PDQ shipping container, thus increasing efficiency in the supply chain.

Embodiments of the invention that can be employed for single and/or multiple shipping and display container executions offer significant advantages in the supply chain. A universal pre-packed shipping and display container for embodiments of the invention may be designed to be erected and loaded with product using a minimal amount of labor. The universal pre-packed shipping and display container design concept may also create an opportunity for a secondary packaging operation to become more efficient because of a repetitiveness of the erecting and loading processes.

Embodiments of the invention focus on improving both structural design elements and execution processes of shipping and display containers that provide vast improvements over existing PDQ processes by offering a streamlined design concept which can service a wide variety of brands and consumer packaged goods (CPG's) while providing significant efficiencies in both the supply chain and display development processes. For example, a significant design improvement for embodiments of the invention includes a connector or bridge element that connects tray elements together and folds or accordions between the tray elements so that the trays may be more compactly positioned for shipment. Upon arrival at a retailer's store, the bridge element may be extended to allow the trays to be repositioned apart from one another for display.

A shipping and display container for embodiments of the invention may include a number of components. The components may include, for example, two tray elements for holding products and a bridge element which connects the tray elements together and folds in the middle which allows the pre-packed shipping and display container to provide efficiency throughout the supply chain. The bridge element may also have a strip of twin stick tape applied to affix the universal pre-packed shipping and display container for embodiments of the invention to an optimal position on a retail shelf.

Other components for embodiments of the invention may include, for example, a header card element which may have a pop-up portion in the rear for structural stability and which may be configured to join the two tray elements together in a slideable relationship. The graphic header card element may fold essentially flat to significantly minimize the space for shipment. Additional components for embodiments of the invention may include a unique lifter tray which simplifies the removal of the display container from an RSC (regular slotted container) shipping container at the retail store. Another option is to use an HSC (half slotted container) shipping container as the cover for the display container. The HSC execution eliminates the need for a lifting tray and further simplifies the shelf readiness of the display container at the retail store.

It may be necessary and/or desirable to utilize other components for embodiments of the invention based, for example, on sizes and shapes of the products themselves. For example, one or more die cut platforms may be employed to organize or divide the product in each of the two tray elements. Additionally, a particular shipping and display container for embodiments of the invention may have one or more removable product protectors that fit over a top of the products to secure the products during shipment. Such protectors may be removed at retail and placed into a recycling stream. Each product mix, for example, of quantity, size, and/or shape may determine whether other components may be required to execute a successful universal pre-packed shipping and display container program for embodiments of the invention.

Embodiments of the invention provide a new design for a shipping and display container of a type for use by suppliers to ship products to retailers and for use by retailers as a tray to display the products for sale. While such shipping and display containers may be produced in any number of different sizes, a current size preference of many retailers may be a pre-loaded shipping and display container that may be deployed as a 30-inch long display container. A reason for that preference is that a display of that size fits easily on a particular size and type of retail display shelf which is commonly employed by many retailers. An issue with a container of that size is that a 30-inch container is not well suited, for example, for a 40×48 inch pallet that is commonly used in shipping products. For example, when a 40×48 inch pallet is loaded with 30-inch containers, it is not possible to maximize use of the capacity of the pallet.

Embodiments of the invention provide a universal shipping and display container that is a better fit for a commonly-dimensioned pallet, thus assuring, for example, better utilization and lower freight cost. Further, shipping and display containers for embodiments of the invention may be used to display products on all shelf sizes most commonly used by retailers. Moreover, such shipping and display containers provide full product visibility when used to display products on virtually any size shelf currently in use by major retailers.

Embodiments of the invention may provide, for example, a two-tray shipping and display container having a foldable bridge that connects the two trays. The foldable bridge may accordion or fold up to bring the two trays of the container into close proximity with one another for shipping, such that the size of the container is relatively small, such as 24 inches in length. The two trays of the shipping and display container may be pre-loaded with product and shipped to a retailer. When received by the retailer, the bridge may be extended by unfolding for use of the container as a product display of a greater length, such as 30 inches. The shipping and display containers for embodiments of the invention are universal in that they may be used to ship and display a wide variety of products of different sizes.

In addition, the shipping and display containers for embodiments of the invention may include elements, such as various types of inner packs that protect the products during shipment. Such inner packs may be custom-designed based, for example, on a nature of the product itself, a size of the product, a shape of the product, and/or a weight of the product. It is to be understood that the foregoing references to particular sizes or dimensions are examples only and that embodiments, components of embodiments, or features of embodiments are not limited to any particular sizes or dimensions.

Figure 1B:
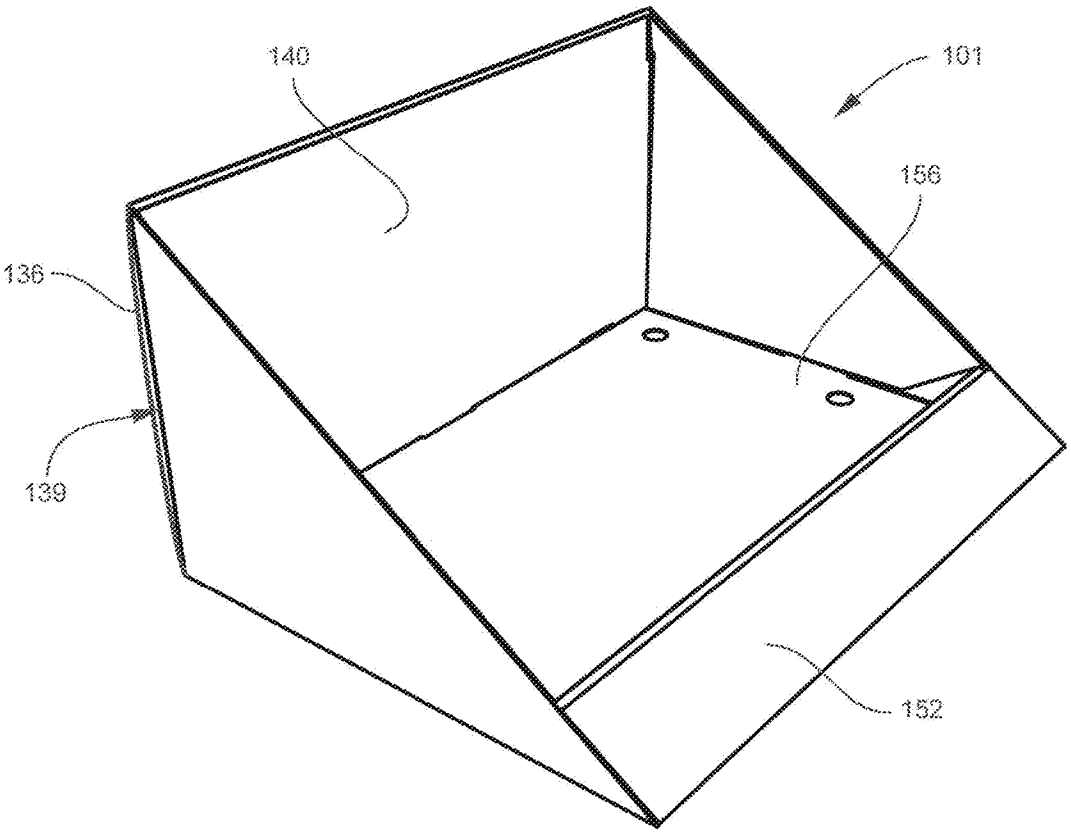
FIG. 1B is a side top perspective view of an example of a tray element formed from a blank of sheet material as shown in FIG. 1A according to embodiments of the invention.

FIG. 1A is a plan view of an example of a blank 100 of sheet material for forming a tray element for a shipping and display container for embodiments of the invention. FIG. 1B is a side top perspective view of an example of a tray element 101 formed from blank 100 of FIG. 1A according to embodiments of the invention. To form the tray element 101 shown in FIG. 1B, referring to FIG. 1A, first trapezial reinforcing member 102 may be folded in arrow direction 103 along fold line 106 onto first triangular side panel 110 and fastened to first side panel 110, for example, by adhesive or other suitable fastening technique. Likewise, second trapezial reinforcing panel 104 may be folded in arrow direction 105 along fold line 108 onto second triangular side panel 112 and similarly fastened to second side panel 112. Thereafter, first side panel 110 may be folded in arrow direction 111 along fold line 114 to a position substantially perpendicular to bottom panel 118, and second side panel 112 may likewise be folded in arrow direction 113 along fold line 116 to a position likewise substantially perpendicular to bottom panel 118 and opposite first side panel 110.

To continue forming the first tray element 101 shown in FIG. 1B, referring further to FIG. 1A, first side panel back flap 120 may be folded in arrow direction 121 to a position substantially perpendicular to first side panel 110, and second side panel back flap 124 may be folded in arrow direction 125 to a position substantially perpendicular to second side panel 112. Likewise, first side panel front flap 128 may be folded in arrow direction 129 along fold line 130 to a position substantially perpendicular to first side panel 110, and second side panel front flap 132 may be folded in arrow direction 133 along fold line 134 to a position substantially perpendicular to second side panel 112. Thereafter, first back panel 136 may be folded in arrow direction 137 along fold line 138 to a position substantially perpendicular to bottom panel 118 and essentially confronting first side panel back flap 120 and second side panel back flap 124, and second back panel 140 may be folded in arrow direction 141 along fold line 142 to a position likewise substantially perpendicular to bottom panel 118 and overlapping first side panel back flap 120 and second side pane back flap 124 and essentially confronting first back panel 136.

Continuing with formation of the tray element 101 shown in FIG. 1B, again referring to FIG. 1A, front panel 144 may be folded in arrow direction 145 to a position essentially confronting first side panel front flap 128 and second side panel front flap 132. Thereafter, front panel 144 may be first folded in arrow direction 147 along fold line 148 and reverse folded in arrow direction 149 along fold line 150 to a position in which a first portion 152 of front panel 144 essentially confronts first and second panel front flaps 128, 132, a second portion 154 of front panel 144 overlaps first and second panel front flaps 128, 132. A third portion 156 of front panel 144 may then be urged to a position essentially confronting bottom panel 118.

Referring to FIGS. 1A and 1B, when tray element 101 is formed, an acute angle, such as a 45 degree angle, may be defined between first portion 152 of front panel 144 and third portion 156 of front panel 144 in the position essentially confronting bottom panel 118. In embodiments of the invention, graphics may be printed directly on an exposed area of first portion 152, or such graphics may be printed on a sheet of suitable material and the printed sheet may be laminated on the exposed area of first portion 152 of front panel 144. In either case, the acute angle orientation of first portion 152 assures that such graphics may be clearly visible regardless of an elevation of a retailer's display shelf on which the tray element 101 may be deployed. Thus, a customer may be able to see the graphics on a tray element 101 located on a lower shelf of a retailer.

Figure 1C:
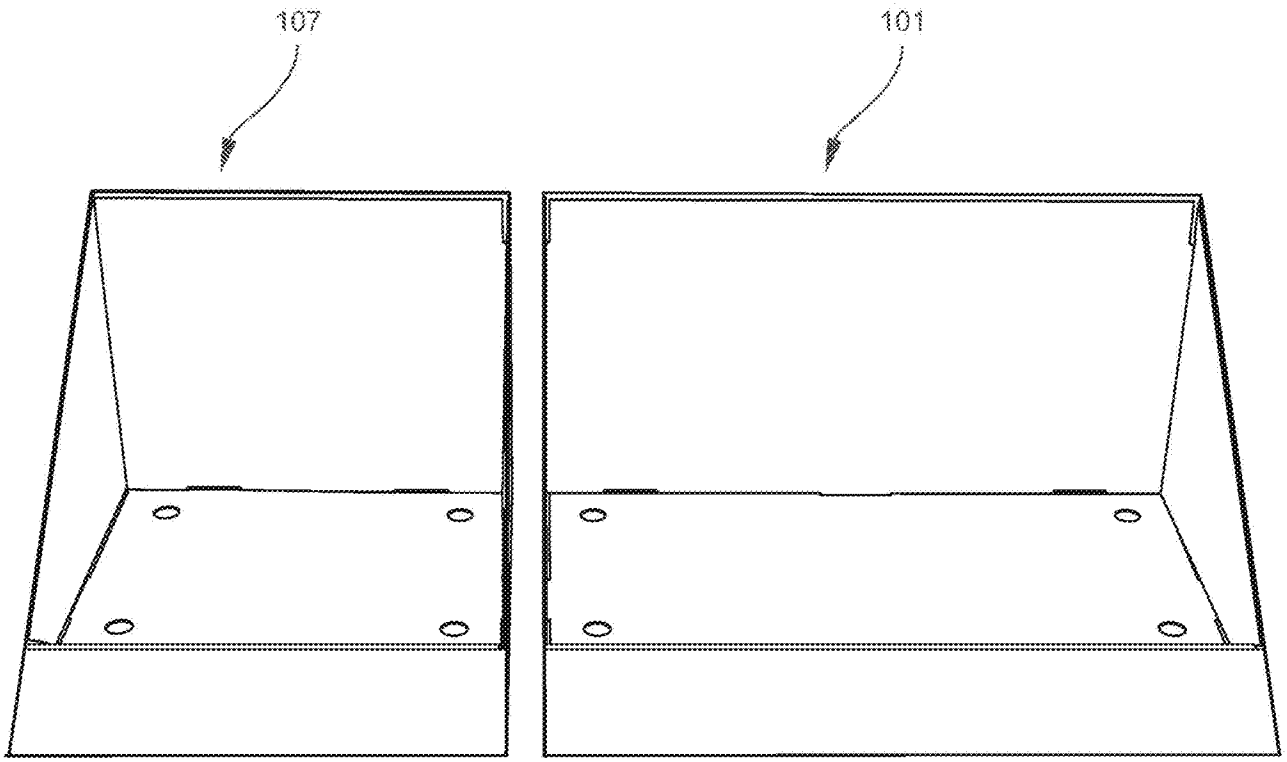
FIG. 1C is a front top perspective view of an example of different sized tray element for embodiments of the invention.

As previously noted, a shipping and display container for embodiments of the invention may include any number of tray elements in addition to tray element 101. The number and size of tray elements may depend, for example, at least in part on a product to be shipped and displayed in a shipping and display container for embodiments of the invention. Embodiments of the invention may employ, for example, multiple tray elements of different sizes. FIG. 1C is a front top perspective view of tray element 101 and a smaller tray element 107. Tray element 107 may be formed from a blank essentially identical to blank 100 but having different dimensions and by essentially the same process as described with respect to forming tray element 101 from blank 100.

It is to be noted, that a shipping and display container for embodiments of the invention is not limited to any particular number of tray elements or size of tray elements or relative sizes of multiple tray elements. Thus, any additional tray elements may be smaller, larger, or the same size as tray element 101. In any case, such additional tray elements may be formed from a blank, such as blank 100, by essentially the same process as described with respect to tray element 101. Obviously, in the case of tray elements of different sizes, the dimensions of aspects of blank 100 may vary in proportion to the differences in sizes of the tray elements.

Figure 2A:
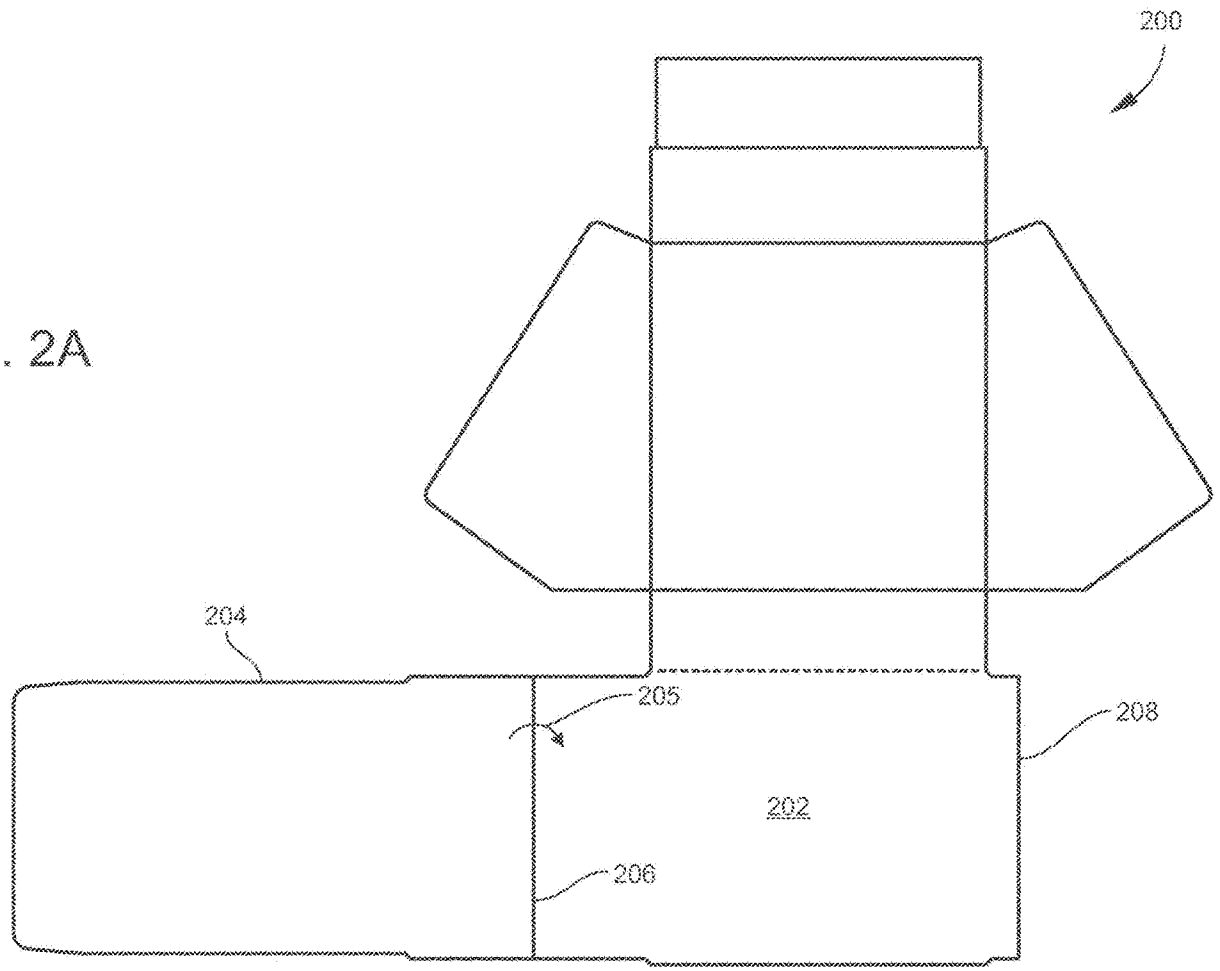
FIG. 2A is a plan view of an example of a blank of sheet material for forming a header card element for the shipping and display container for embodiments of the invention.
Figure 2B:
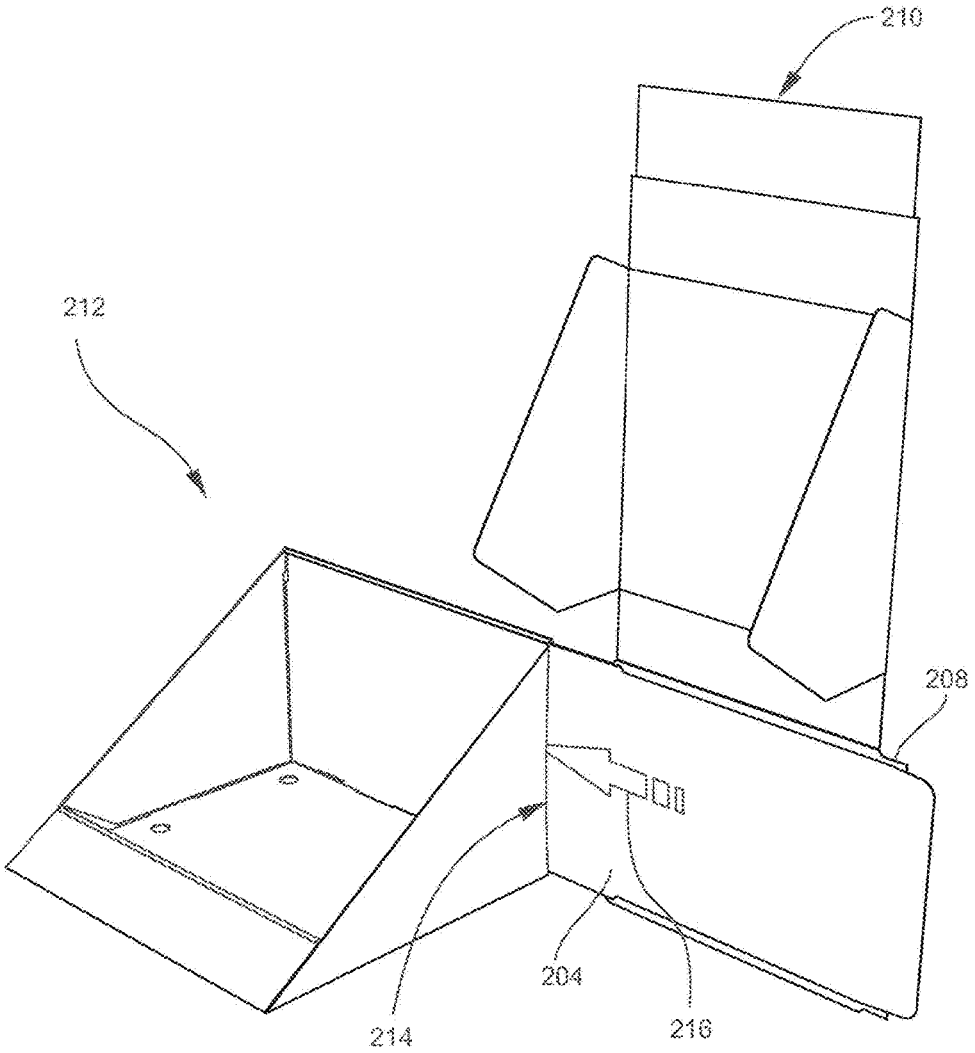
FIG. 2B is a side top perspective view showing an example of a process of joining a first tray element and a header card element for the shipping and display container for embodiments of the invention.

FIG. 2A is a plan view of an example of a blank 200 of sheet material for forming a header card element for the shipping and display container for embodiments of the invention. Referring to FIG. 2A, first portion 204 of back panel 202 may be folded in arrow direction 205 along fold line 206 to a position essentially confronting second portion 208 of back panel 202. FIG. 2B is a side top perspective view showing an example of a process of joining a first tray element 212 and a header card element 210 for the shipping and display container for embodiments of the invention. As previously noted, in forming a tray element for embodiments of the invention, as shown in FIG. 1A, second back panel 140 may be folded in arrow direction 141 along fold line 142 to a position substantially perpendicular to bottom panel 118 and essentially confronting first back panel 136. Thus, in forming the tray element, as shown in FIG. 1B, a narrow gap or sleeve 139 may be defined between second panel 140 and first panel 136. Referring to FIG. 2B, header card element 210 may be joined with first tray element 212 by inserting folded together portions or limbs 204 and 208 of back panel 202 of header card element 210 into a similarly defined sleeve at 214 and sliding folded together portions or limbs 204 and 208 into the sleeve in arrow direction 216 as far as they will go. When thus inserted, one or more fasteners, such as one or more staples, may be utilized to fix folded together portions or limbs 204 and 208 of back panel 202 of header card element 210 to first tray element 212.

Figure 2C:
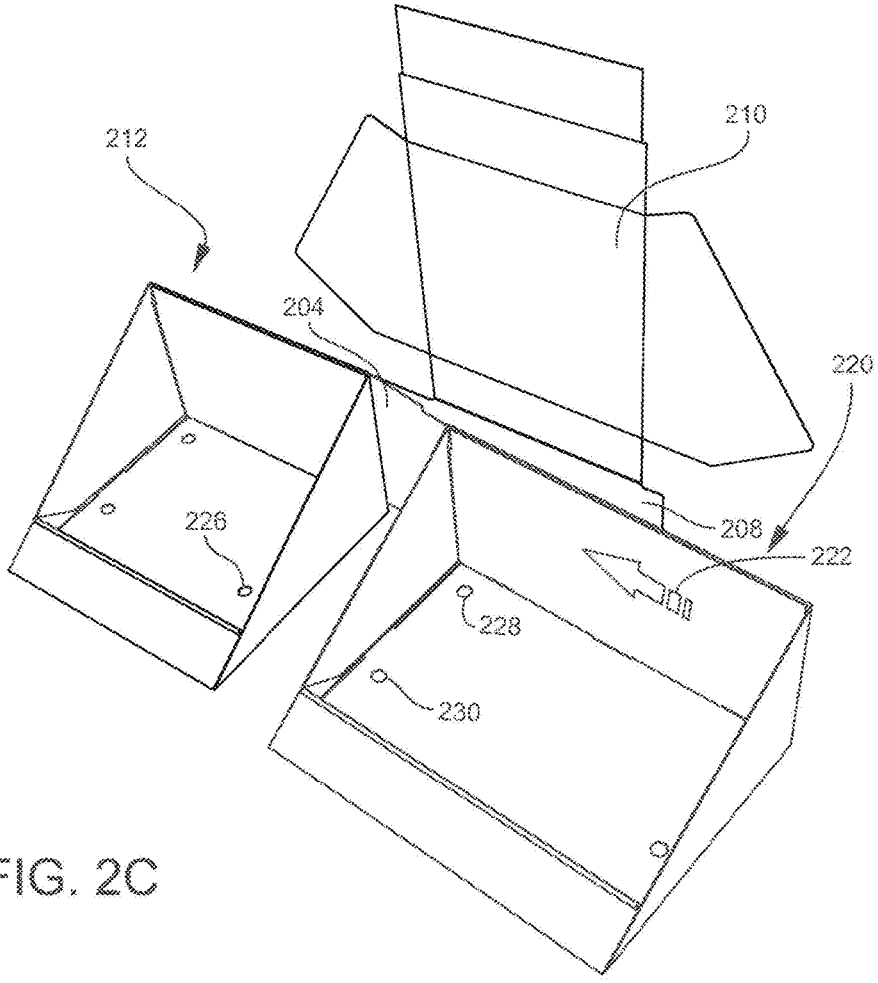
FIG. 2C is a side top perspective view showing an example of a process of joining a second tray element to a header card element for embodiments of the invention.

FIG. 2C is a side top perspective view showing an example of a process of joining a second tray element 220 to the header card element 210 for embodiments of the invention. Referring to FIG. 2C, as previously noted, in forming a tray element, such as tray element 101, a narrow gap or sleeve 139, as shown in FIG. 1B, may be defined between second panel 140 folded to confront first panel 136. Referring to FIG. 2C, the second tray element 220 may be joined with header card element 210 by inserting folded portion or single limb 204 of back panel 202 of header card element 210 into a similarly defined sleeve of second tray element 220 and sliding folded portion or single limb 204 into the narrow gap or sleeve by urging second tray element 220 in arrow direction 222 until first and second tray elements 212 and 220 are substantially abutting one another.

Figure 3A:
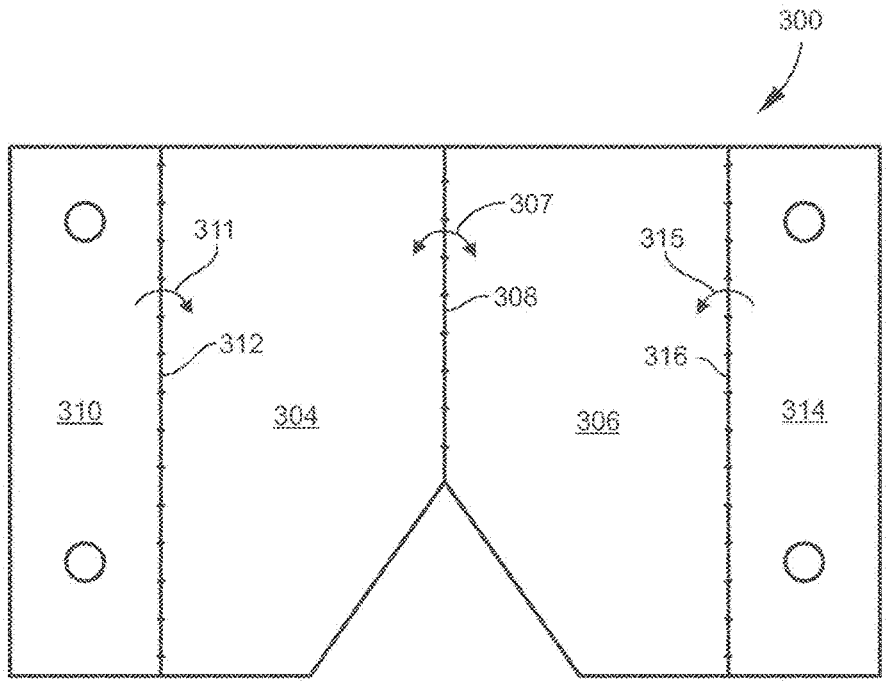
FIG. 3A is a top plan view of a blank of sheet material for forming a bridge element to connect first and second tray elements as shown in FIG. 2C for embodiments of the invention.
Figure 3B:
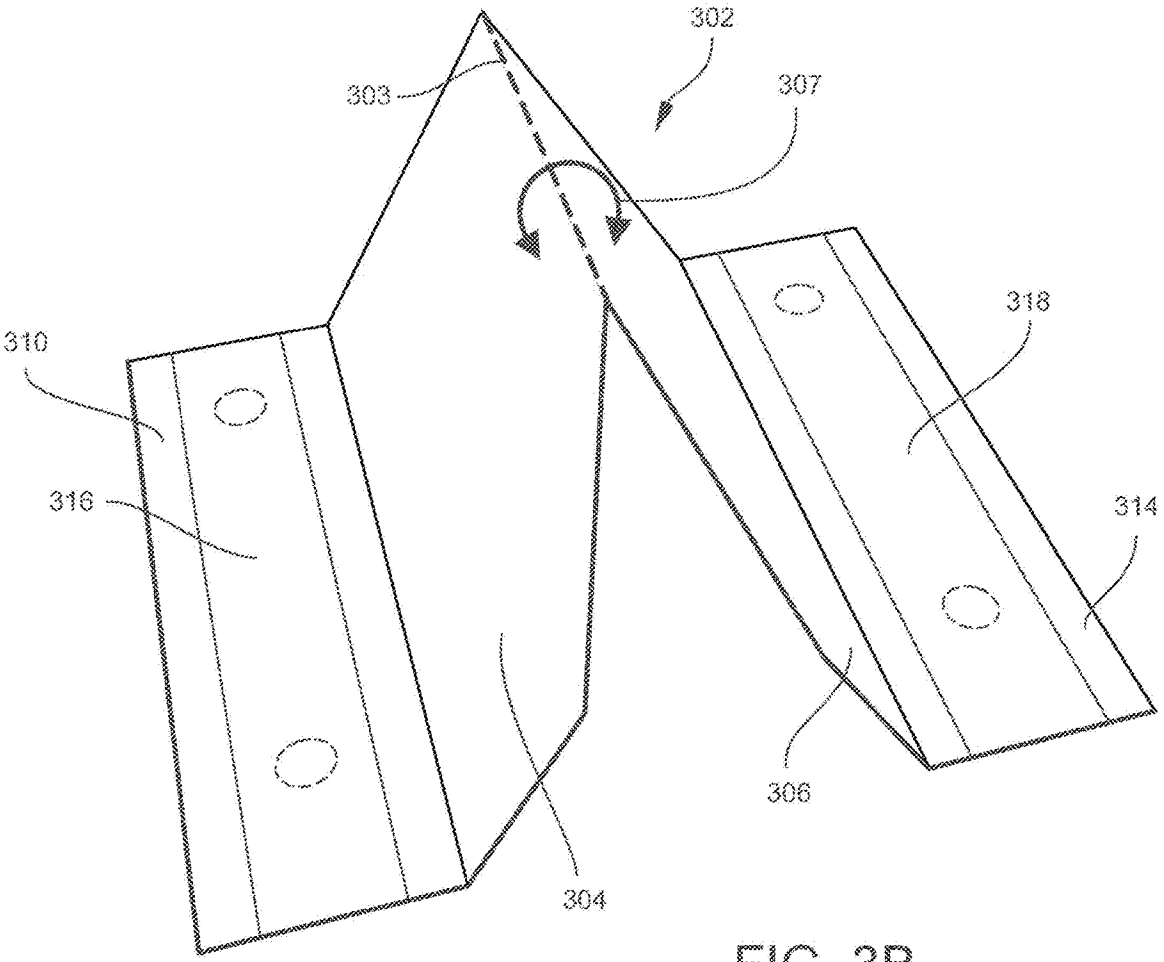
FIG. 3B is a top perspective view of a bridge element formed from a blank of sheet material as shown in FIG. 3A for embodiments of the invention.

FIG. 3A is a top plan view of a blank 300 of sheet material for forming a bridge element to connect first and second tray elements 212, 220, shown in FIG. 2C, for embodiments of the invention. FIG. 3B is a top perspective view of a bridge element 302 formed from blank 300 of FIG. 3A for embodiments of the invention. Referring to FIGS. 3A and 3B, first and second center panels 304 and 306 of blank 300 may be accordion-folded together in arrow direction 307 along fold line 308 to positions essentially confronting one another. In addition, first flap 310 of blank 300 may be folded in arrow direction 311 along fold line 312 to a position substantially perpendicular to first center panel 304, and second flap 314 of blank 300 may be folded in arrow direction 315 along fold line 316 to a position substantially perpendicular to second center panel 306.

Referring to 3B, in order to connect first and second tray elements 212, 220 that were previously joined with header card element 210, shown in FIG. 2C, any suitable fastening technique, such as a pre-determined length of double-faced adhesive medium that may be protected, for example, by a release layer, may be applied at 316, 318 to first and second flaps 310, 314, respectively, of bridge element 302. FIGS.

Figure 3C:
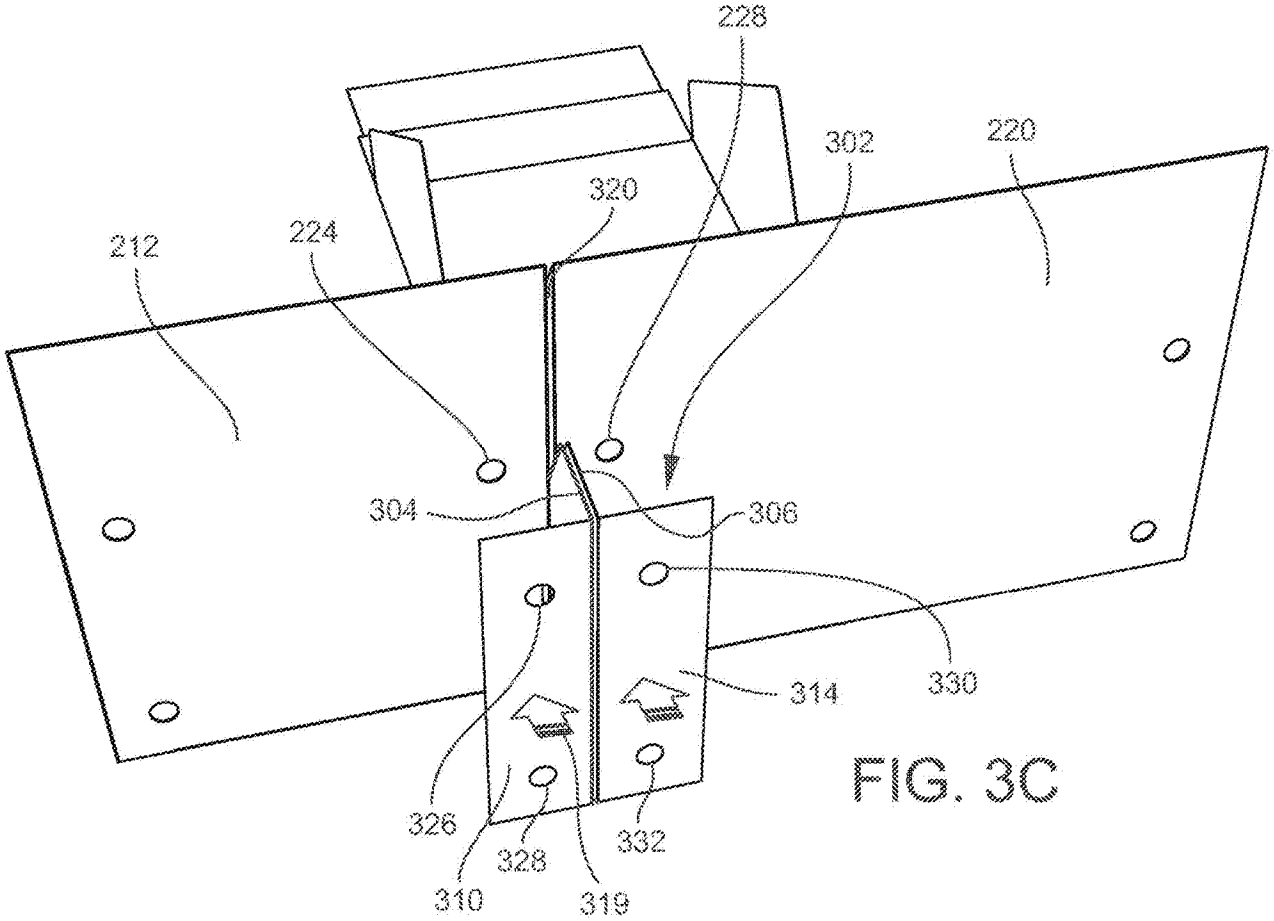
FIGS. 3C and 3D are bottom perspective views showing an example of a process of connecting first and second tray elements by a bridge element for embodiments of the invention.

3C and 3D are bottom perspective views showing an example of connecting first and second tray elements 212, 220 by bridge element 302 for embodiments of the invention. Referring to FIG. 3C, after first removing the release layer from the adhesive medium on the first and second flaps 310, 314, the folded-together first and second center panels 304, 306 of bridge element 302 may be inserted in arrow direction 319 into a gap or sleeve 320 defined between first and second tray elements 212, 220.

Figure 3D:
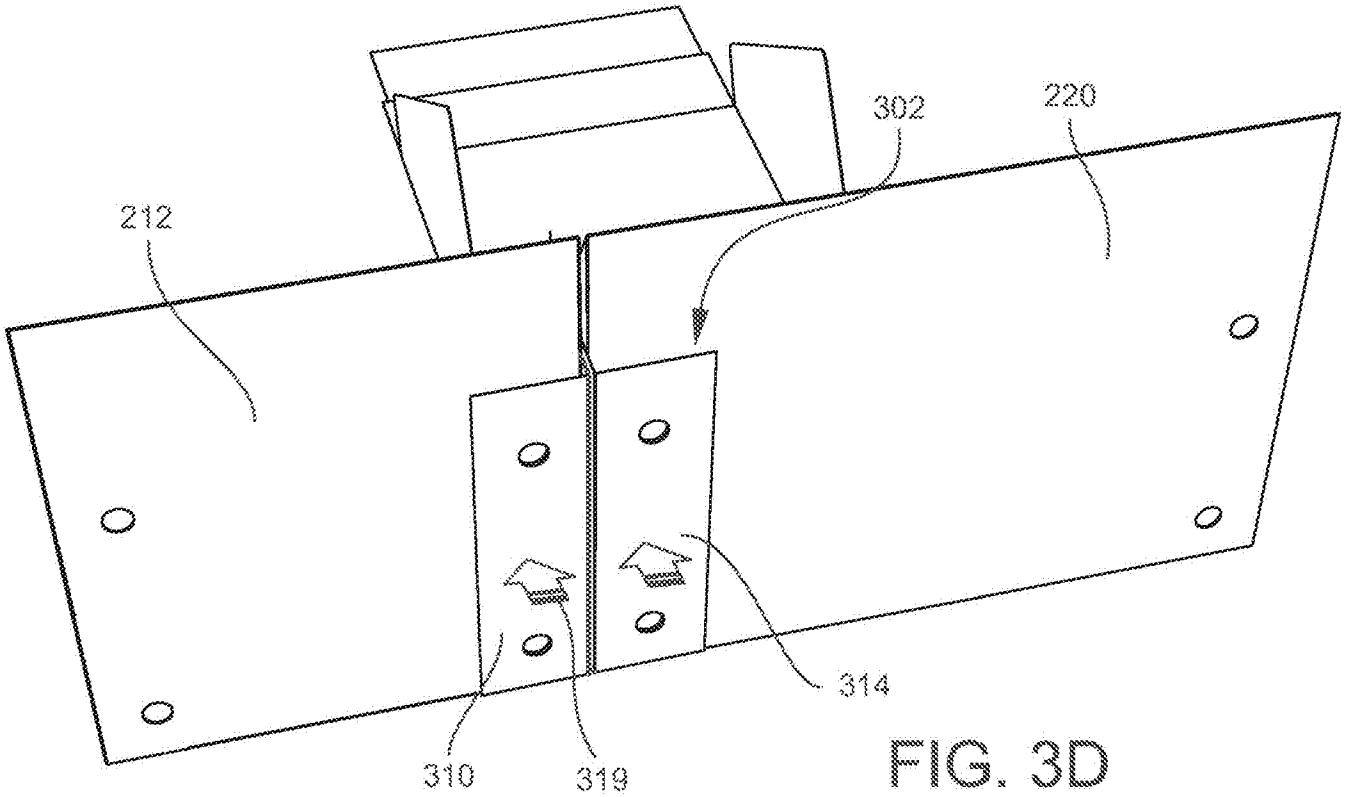

Referring to FIGS. 2C and 3C, in order to properly position bridge element 302 with respect to first and second tray elements 212, 220, first tray element 212 may be provided with guides, such as openings 224, 226, and second tray element 212 may also be provided with guides, such as openings 228, 230. Bridge element 302 may likewise be provided with guides, such as openings 326, 328, in first flap 310 and openings 330 and 332 in second flap 314. Referring to FIG. 3D, bridge element 302 may be urged in arrow direction 319 with guide openings 326, 328 of first flap 310 of bridge element 302 aligned with guide openings 224, 226 of first tray element 212 and guide openings 330, 332 of second flap 314 of bridge element 302 aligned with guide openings 228, 230 of second tray element 220 until the adhesive medium applied to first and second flaps 310, 314 at 316, 318 comes into contact with and fixes first and second flaps 310, 314 to a bottom surface of first and second tray elements 212 and 220, respectively.

As noted, while the foregoing example of a shipping and display container may include two tray elements of different sizes, embodiments of the invention may include any number of tray elements of the same size or different sizes, such as tray elements 212 and 220. Further, in embodiments of the invention, one or more tray elements may be joined to an adjacent tray element via a header card element, such as header card element 210, and connected to the adjacent tray element by a bridge element, such as bridge element 302. In addition, embodiments of the invention may provide a shipping and display container of a particular size preferred by a particular retailer.

Figure 4:
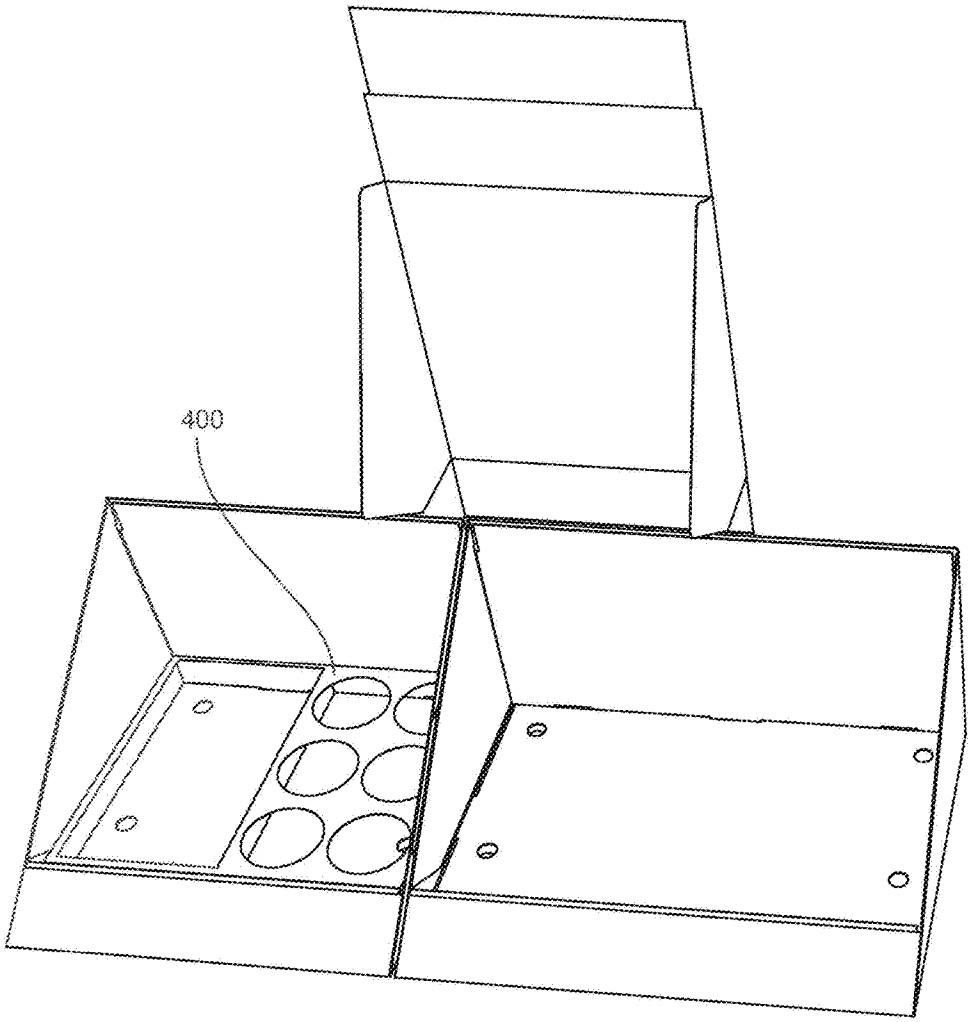
FIG. 4 is a top perspective view of a protector element inserted into one of two tray elements, such as one of two tray elements shown in FIG. 2, of a shipping and display container for embodiments of the invention.
Figure 5:
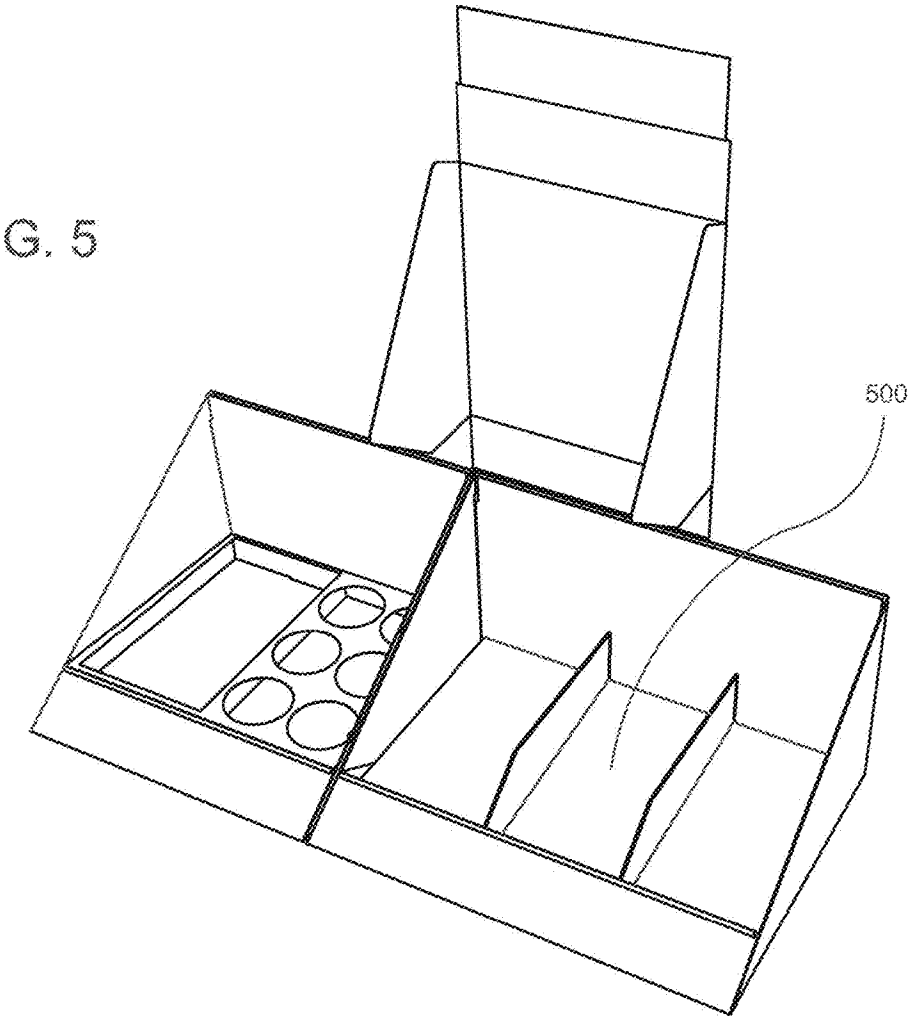
FIG. 5 is a top front perspective view of a divider element inserted into the other of two tray elements, such as the other of two tray elements shown in FIG. 2, of a shipping and display container for embodiments of the invention.

For example, a preferred size of a container for shipping a product may be approximately 24 inches in length that makes efficient use of pallet space. For a further example, such a container measuring 24 inches long by 10 inches wide may be stacked 8 packages in each layer on a 48-inch by 40-inch pallet. On the other hand, a retailer may prefer a display container that is approximately 30 inches in length to display product, such as cans of shaving cream or shaving gel in one of two tray elements and shaving blades in the other of the two tray elements. Embodiments of the invention may address both preferences, for example, by providing a shipping and display container having a product organizer element for holding product in place in one of two tray elements and a product divider for separating product in the other of two tray elements. FIG. 4 is a top perspective view of a protector element 400 inserted into one of two tray elements, such as tray element 212 shown in FIG. 2, of a shipping and display container for embodiments of the invention. FIG. 5 is a top front perspective view of a divider element 500 inserted into the other of two tray elements, such as tray element 210 shown in FIG. 2, of a shipping and display container for embodiments of the invention.

Figure 6:
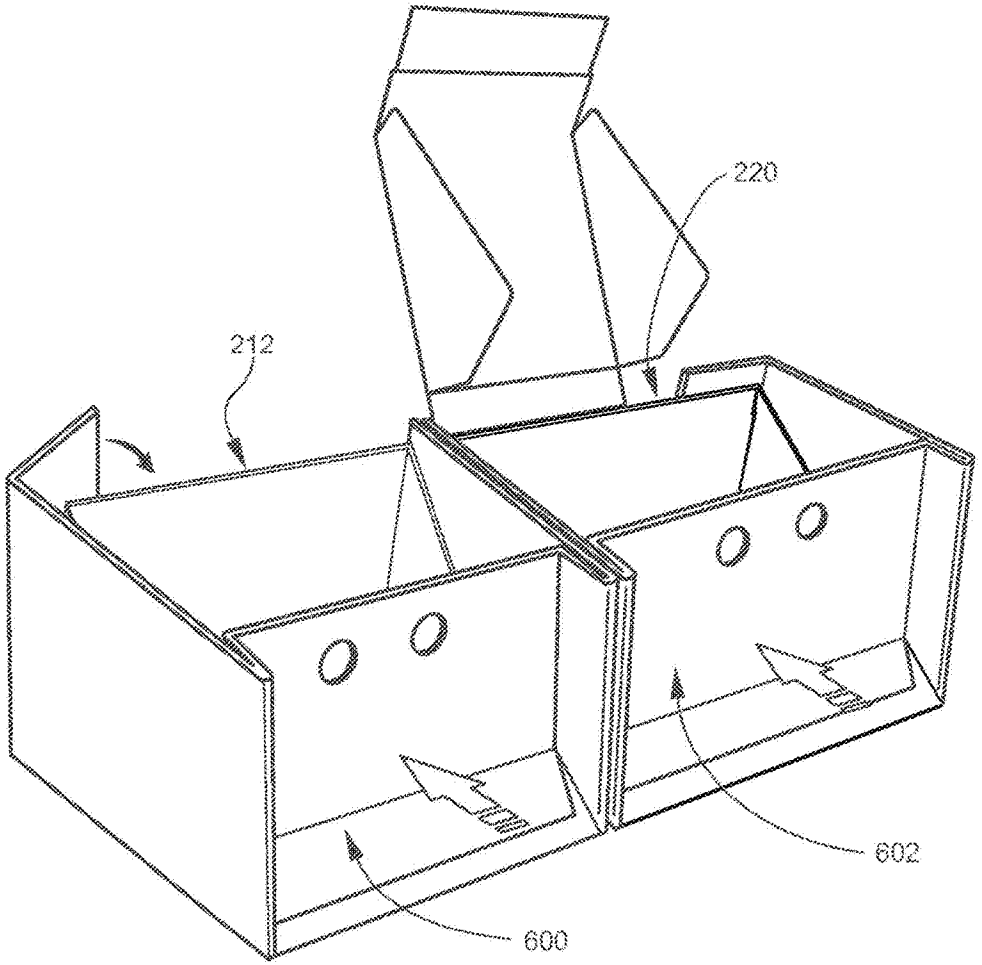
FIG. 6 is a top perspective view of support elements inserted on respective ones of two tray elements of a shipping and display container for embodiments of the invention.

To achieve a preferred container size, for example, of 24 inches for shipping product in a shipping and display container having two tray elements, one tray element, such as tray element 212 shown in FIG. 2C, may be approximately 10 inches in length, and the other tray element, such as tray element 220, may be approximately 14 inches in length. Thus, second tray element 220, may be urged in arrow direction 222 toward the first tray element 212, causing folded portion or limb 204 of back panel 202 of header card element 210 to slide in the sleeve of second tray element 220 until first and second tray elements 212 and 220 are substantially abutting one another, resulting in a shipping and display container approximately 24 inches in length. Thereafter, both trays may be preloaded with product, and a support element may be installed on each tray. FIG. 6 is a top perspective view of support elements 600, 602 inserted on respective ones of two tray elements, such as tray elements 212, 220, of a shipping and display container for embodiments of the invention.

Figure 7:
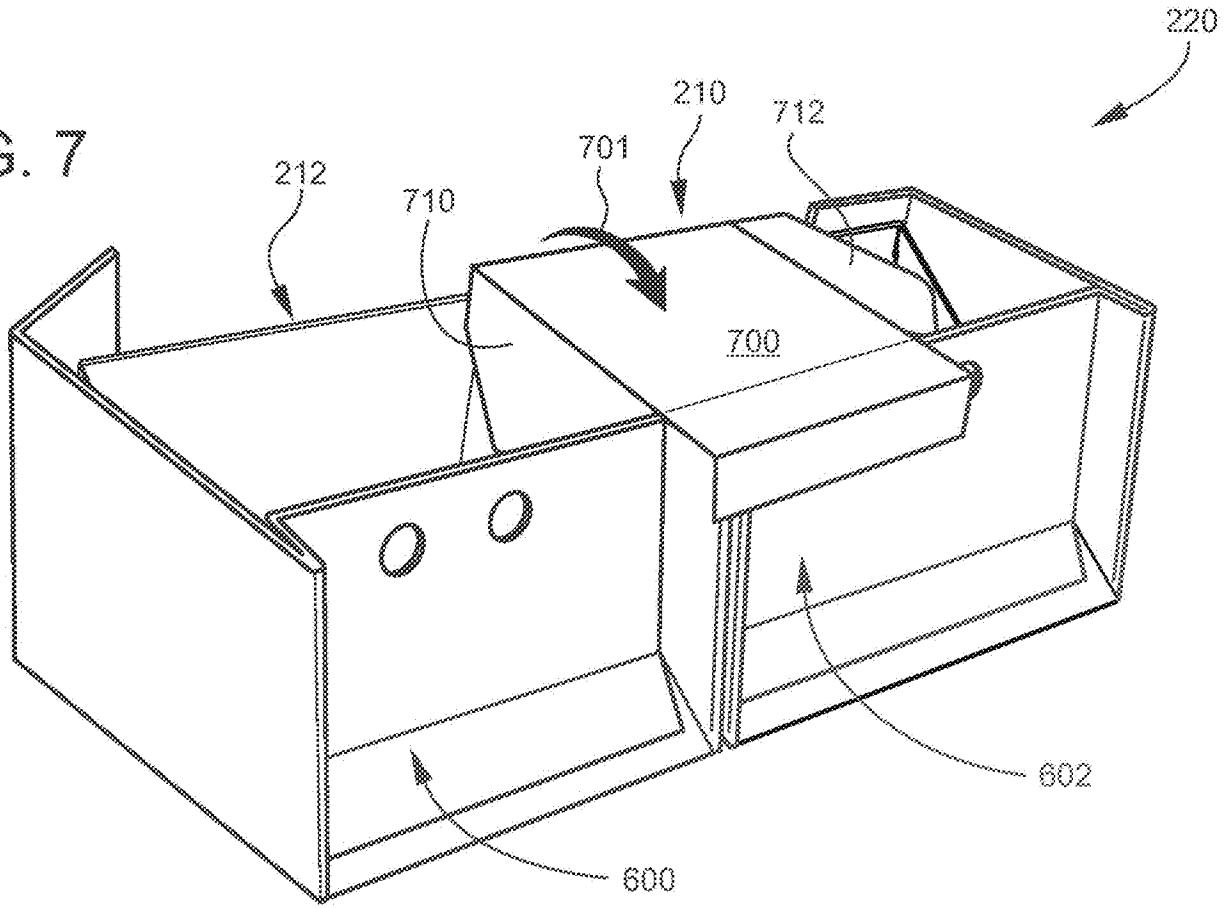
FIG. 7 is a front top perspective view showing an example of a process of covering a product with a cover portion according to embodiments of the invention.
Figure 8:
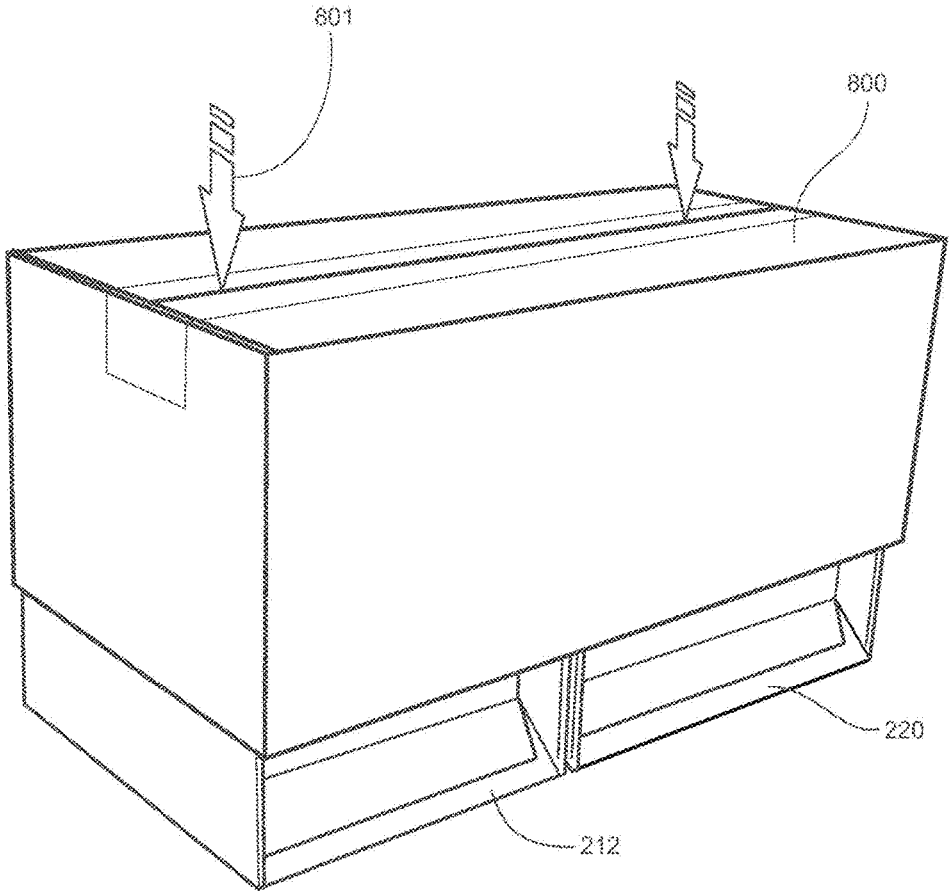
FIG. 8 is a side top perspective view showing an example of a process of covering the product for shipment with a cover according to embodiments of the invention.

Once the support elements 600, 602 are installed, the preloaded products may be covered with a cover portion of the header card element. FIG. 7 is a front top perspective view showing an example of a process of covering the product with a cover portion according to embodiments of the invention. Referring to FIG. 7, a cover portion 700 of the header card element 210 may be folded in arrow direction 701 to cover a substantial portion of one of the two support elements 602. For added protection in shipping, a container, such as a half-slotted container (HSC) may be utilized to cover the preloaded products. FIG. 8 is a side top perspective view showing an example of a process of covering the product for shipment with a cover according to embodiments of the invention. Referring to FIG. 8, an HSC box 800 may be positioned above preloaded first and second tray elements 212, 220 with its open top facing downward in arrow direction 801 and slid downwardly to completely cover the preloaded tray elements for shipping. To secure the preloaded tray elements 212, 220 within the HSC box 800, the combination may be, for example, wrapped with an adhesive tape.

Once a retailer receives one or more of the shipping and display containers for embodiments of the invention preloaded with product, the taped HSC box may be removed. Thereafter, cover portion 700 of header card element 210 may be lifted in a direction opposite arrow direction 701 shown in FIG. 7 to uncover support element 602, and support elements 600, 602 may be lifted and removed from tray elements 212, 220. To achieve a preferred display size, for example, of 30 inches, for displaying the preloaded product, one of the two tray elements, such as second tray element 220 shown in FIG. 2C, may be urged in a direction opposite arrow direction 222 away from the first tray element 212. As the two tray elements are urged apart from one another, the folded-together first and second center panels 304, 306 of bridge element 302, shown in FIGS. 3B, 3C, 3D, disposed between first and second tray elements 212, 220, are pulled by first and second flaps 310, 314 fixed to bottom surfaces of first and second tray elements 212, 220, respectively, in directions opposite arrow directions 307 as shown in FIG. 3B. When folded-together first and second center panels 304, 306 are completely unfolded and extended in a same plane, the first and second tray elements may be spaced apart from one another by a distance equal to a combined width of first and second center panels 304, 306 of bridge element 302, such as approximately 6 inches.

Figure 9:
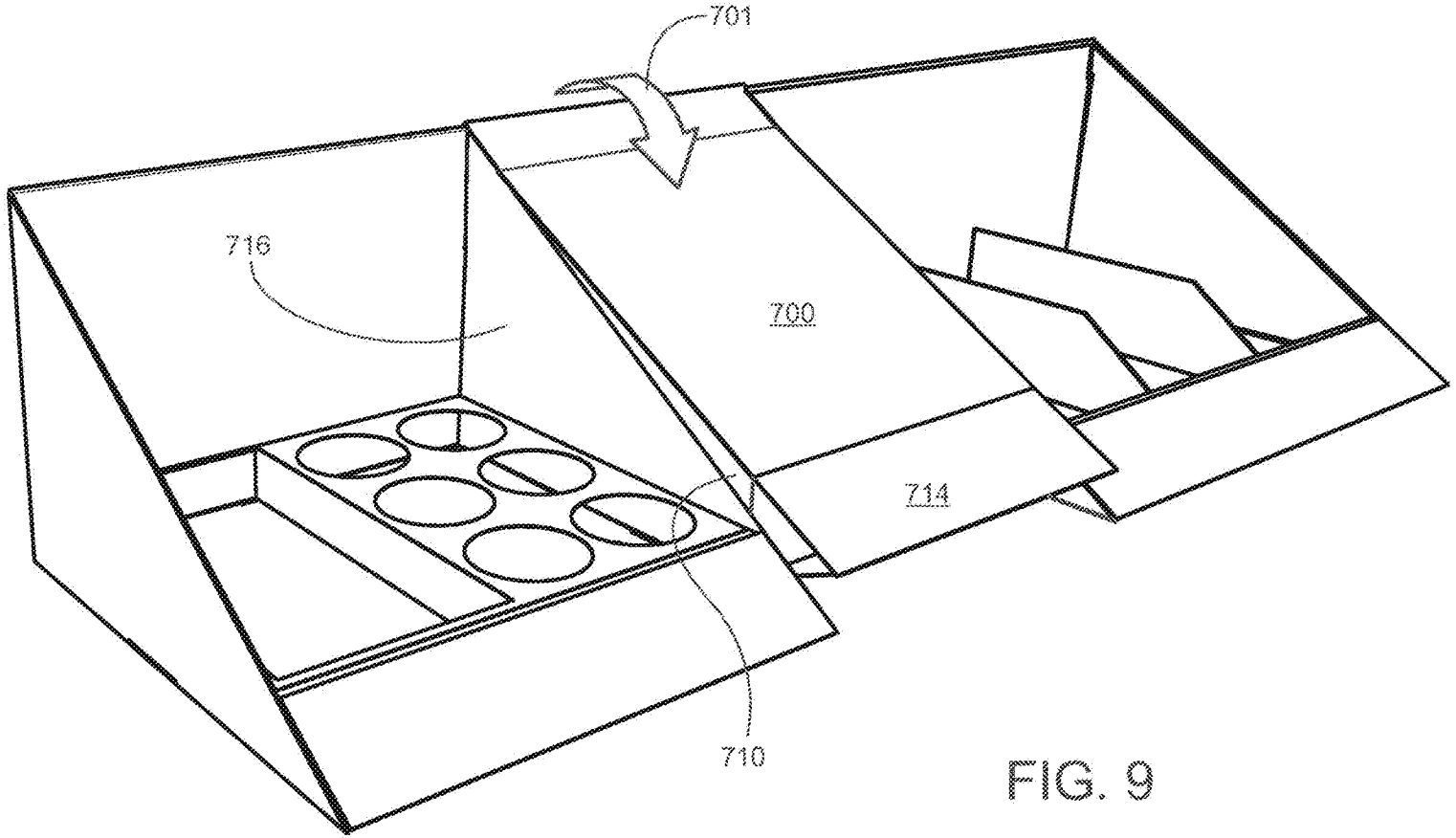
FIG. 9 is a front perspective view of an example of a display for embodiments of the invention.

With the bridge element 302 fully extended, further movement of first and second tray elements 212, 220 apart from one another may be prevented. At that point, a combined length of the first and second tray elements and the distance by which they are spaced from one another may correspond to the retailer's preferred length of a shipping and display container for displaying the preloaded product, such as 30 inches. FIG. 9 is a front perspective view of an example of a display for embodiments of the invention. In order to complete the display, referring to FIGS. 7 and 9, first and second wing portions 710, 712 of header card element 210, as shown in FIG. 7, may be folded perpendicular to cover portion 700 of header card element 210, and front flap 714 may be extended in a plane parallel to cover portion 700. Thereafter, cover portion 700 may be moved in arrow direction 701 to a position covering the space between first and second tray elements 212, 220. As previously noted, either or both of cover portion 700 and front flap 714 may be printed or laminated, for example, with advertising. As also previously noted, such advertising may be clearly visible even if the retailer deploys the display on a lower shelf.

Figure 10:
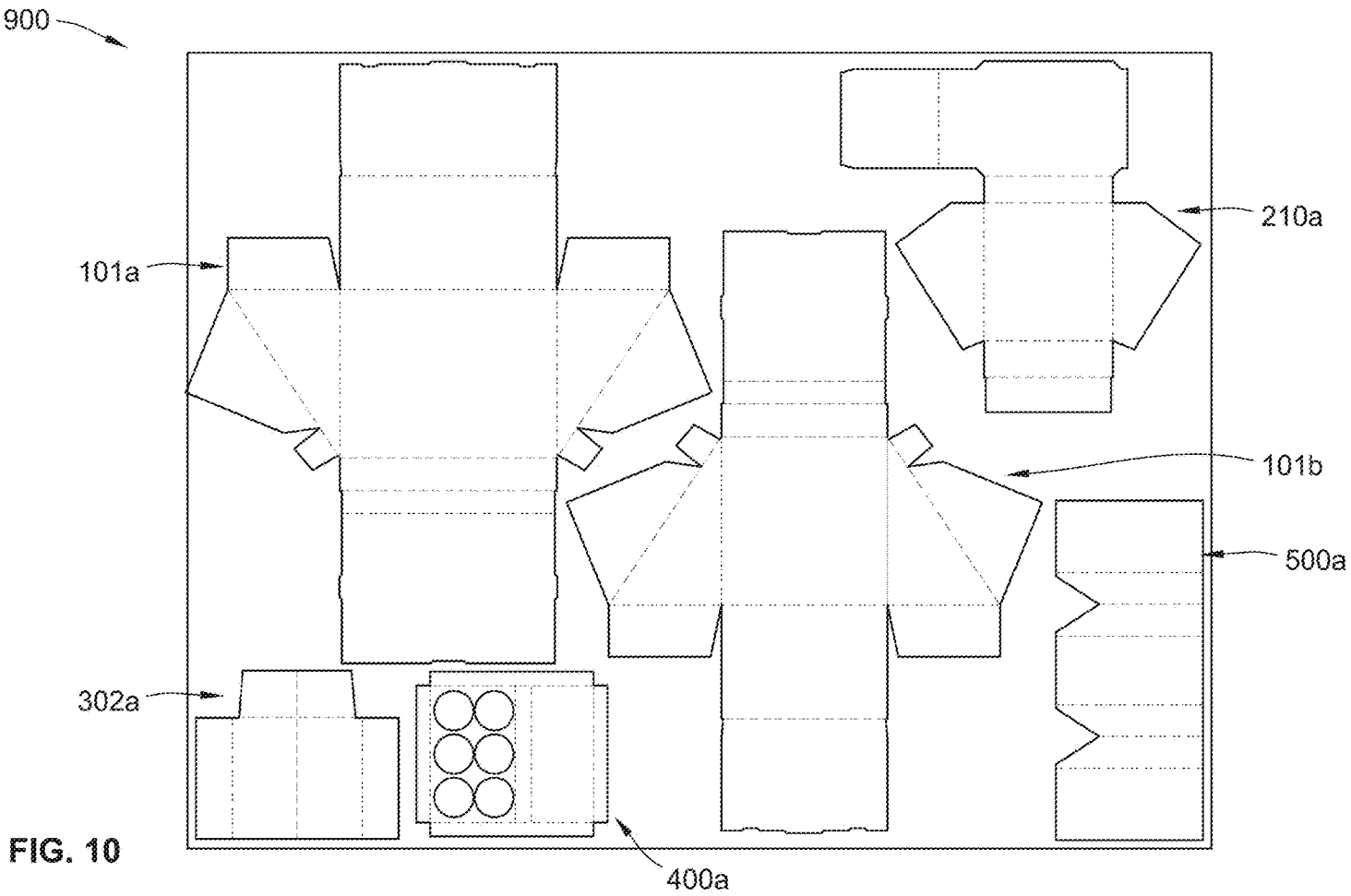
FIG. 10 is a plan view of an example of a blank of sheet material for forming a shipping and display container according to embodiments of the invention.

FIG. 10 is a plan view of a blank or sheet 900 for forming a shipping and display container. The blank or sheet 900 may be, for example, a single die-cut sheet. The blank or sheet 900 includes a first tray element 101*a*, a second tray element 101*b*, a header card element 210*a*, a bridge element 302*a*, a protector element 400*a*, and a divider element 500*a*. Each of these elements shown in FIG. 10, as well as additional elements that are not shown in FIG. 10, may be included on blank or sheet 900. Also, all of the elements on blank or sheet 900 are separate elements that are individually formed prior to assembling a shipping and display container of the present invention, as described herein. Some of the elements shown in blank or sheet 900 may include pre-glued portions to enable easier and faster formation of the elements, such as, for example, first and second tray elements 101*a* and 101*b*.

As noted above, the blank or sheet 900 includes several of the elements for making the shipping and display container—the first tray element 101*a*, the second tray element 101*b*, the header card element 210*a*, the bridge element 302*a*, the protector element 400*a*, and the divider element 500*a*—on a single blank or sheet 900. This provides for improved efficiencies in making and transporting the shipping and display containers. As noted earlier, the shipping and display containers of the present invention are a better fit for a commonly-dimensioned pallet, thus assuring, for example, better utilization and lower freight cost. Also, tooling charges and art preparation may incur lower costs as only a single format will need to be provided, instead of each element being provided separately.

Figure 11:
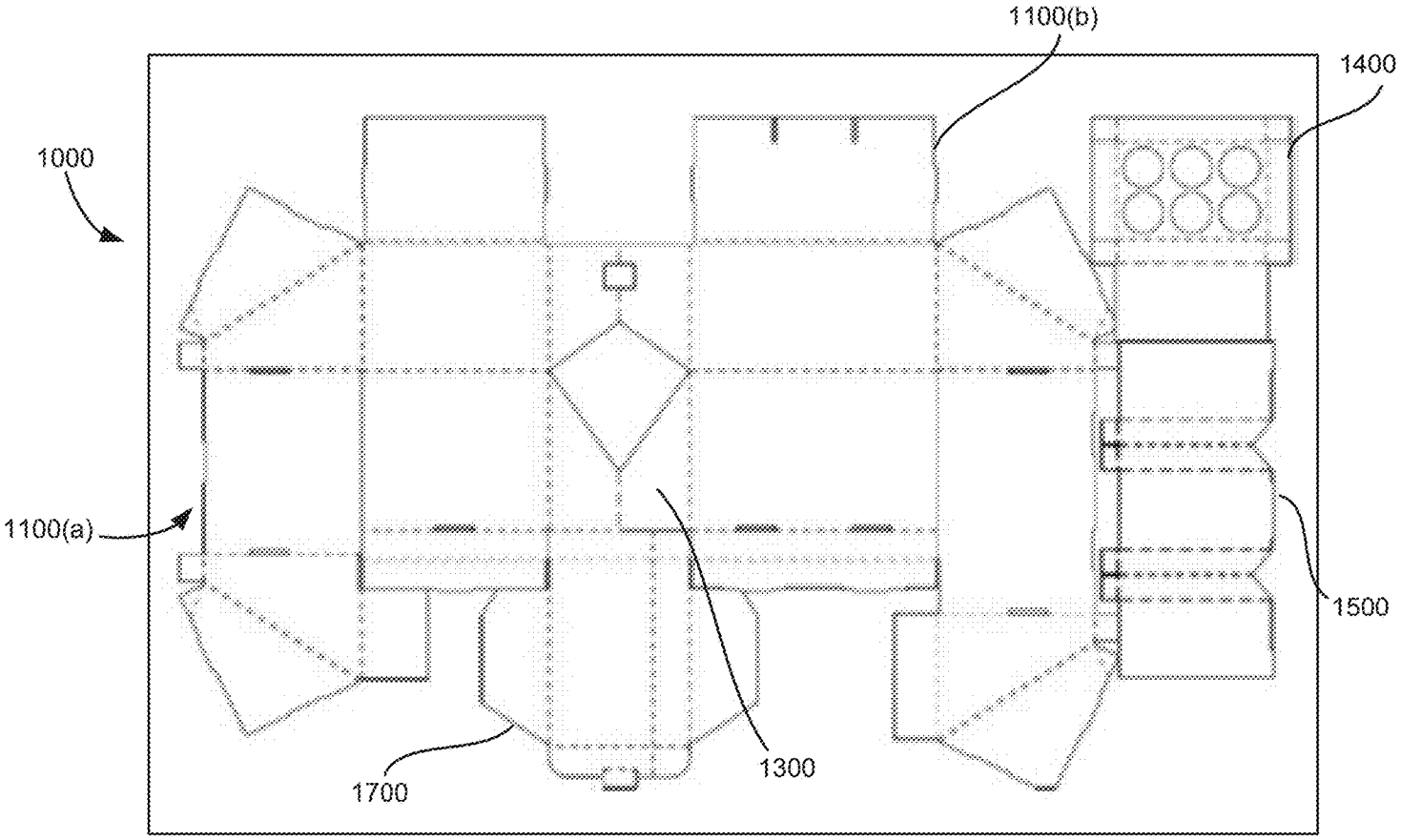
FIG. 11 is a plan view of an example of a blank of sheet material for forming a shipping and display container according to embodiments of the invention.

FIG. 11 is also a plan view of a blank or sheet 1000 for forming a shipping and display container of the present invention. The blank or sheet 1000 includes a first tray element 1100*a*, a second tray element 1100*b*, a bridge element 1300, a protector element 1400, a divider element 1500 and a cover element 1700. The cover element 1700, similar to the cover portion 700, is adapted for covering a space between the first and second tray elements. The dotted lines in FIG. 11 indicate a foldable portion of one or more of the elements of the shipping and display container. Additional elements may also be included on blank or sheet 1000, in addition to those shown in FIG. 11.

In contrast to the elements on blank or sheet 900, several of the elements on blank or sheet 1000 are provided as part of a single unit and are not individually formed prior to assembling the shipping and display container. In other words, several of the elements are interconnected so as to form a single unit that is integrally formed in a single blank or sheet.

For example, as shown in FIG. 11, the first tray element 1100(*a*), the second tray element 1100(*b*), the divider element 1300 and the cover element 1700 are interconnected to form the shipping and display container (shown in FIGS. 12A-G and 13A-B). The use of a single-unit structure, with elements integrally formed in a single blank or sheet, requires less material and is easier to assemble, and may include fewer elements as well. In addition, the single unit does not require any pre-glued portions or adhesives. Instead, the single-unit structure is able to be folded into the final shipping and display container that will be stocked with products and shipped to retailers.

In FIG. 11, the protector element 1400 and the divider element 1500 are not interconnected with the first tray element 1100(*a*), the second tray element 1100(*b*), the divider element 1300 and the cover element 1700, and thus do not form part of the single unit. However, these elements, and others not shown in FIG. 11, may be included as part of a single-unit structure that are integrally formed in a single blank or sheet, in accordance with the shipping and display container described herein.

Figure 12B:
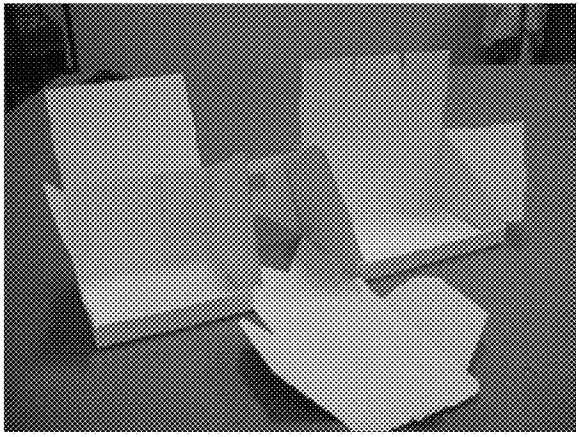
FIGS. 12(*a*) through 12(*g*) are front perspective views of an example of the assembly of a shipping and display container according to embodiments of the invention.
Figure 12D:
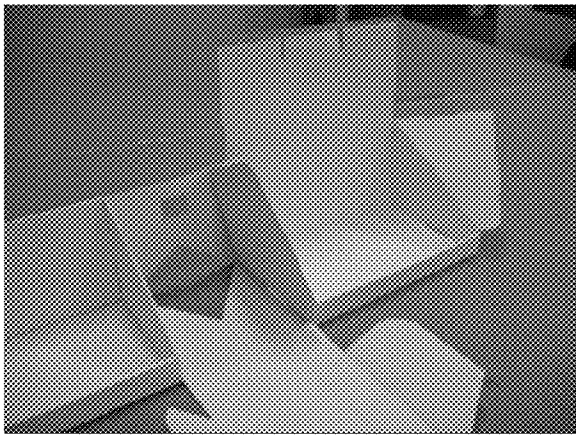
Figure 12A:
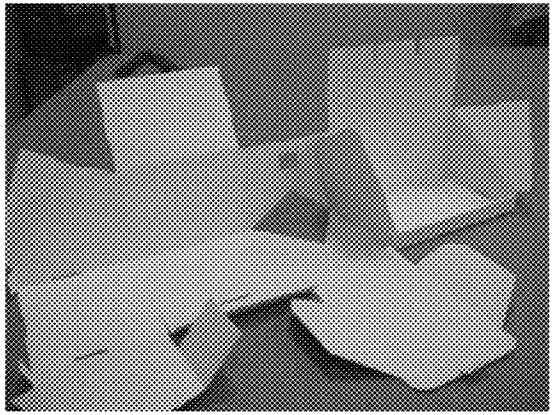
Figure 12C:
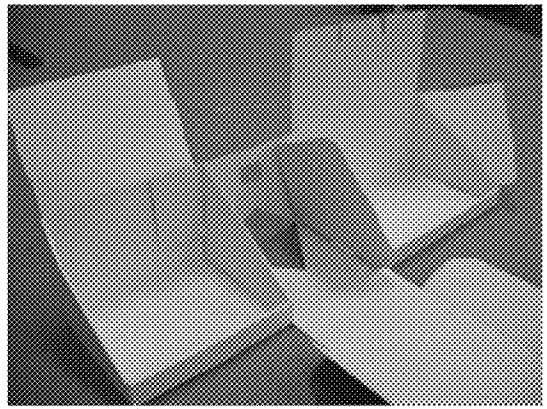
Figure 12F:
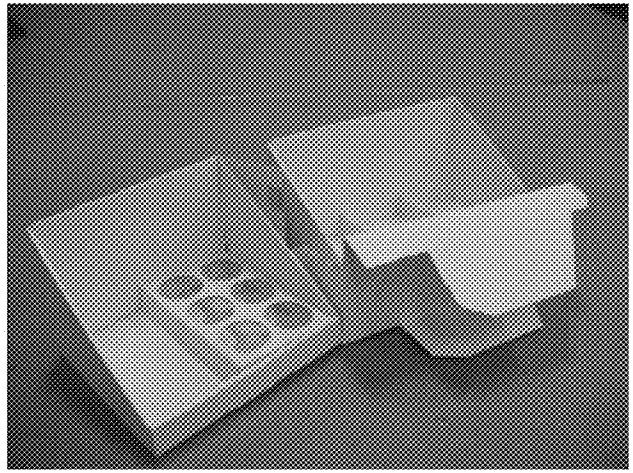
Figure 12E:
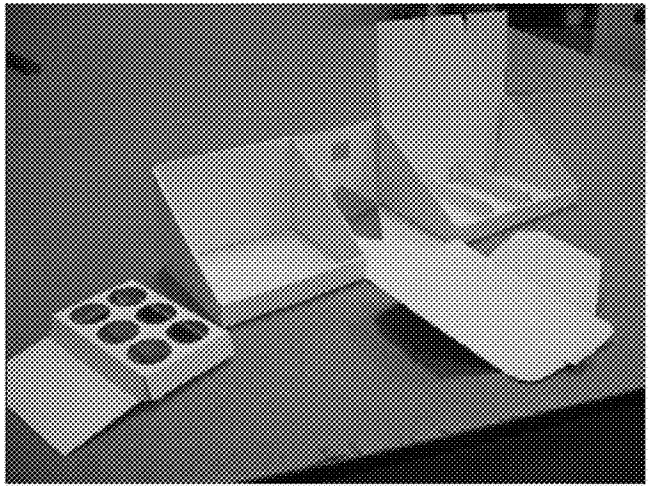
Figure 12G:
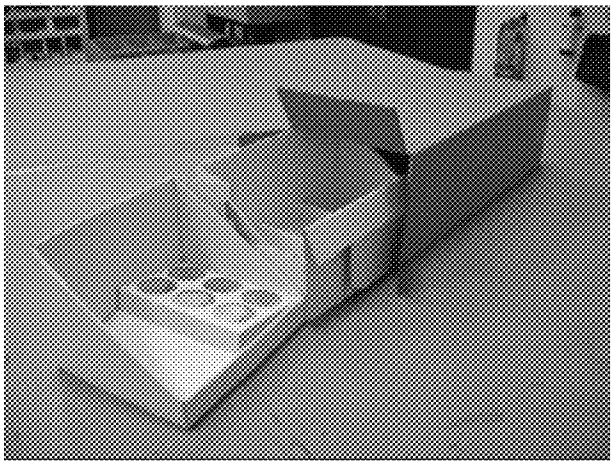

FIGS. 12A through 12G are front perspective views of one example of the assembly of a shipping and display container according to the present invention. These figures (FIG. 12A-12F) illustrate the single-unit structure and the step-wise folding of portions of the elements to form the shipping and display container, and the final packaging of the container in FIG. 12G. For example, FIGS. 12A-12D illustrate the formation of the first and second tray elements (1100(*a*) and 1100(*b*)), with the divider element 1300 located between the tray elements, and the cover element 1700 adjacent to the divider element 1300. FIG. 12E illustrates the protector element 1400 and the divider element 1500 positioned in the first tray element 1100(*a*) and second tray element 1100(*b*). FIG. 12F illustrates the cover element 1700 folded onto the first tray element 1100(*a*) and the second tray element 1100(*b*), and the tray elements being positioned together and placed into an end load shipper (FIG. 12G).

Figure 13A:
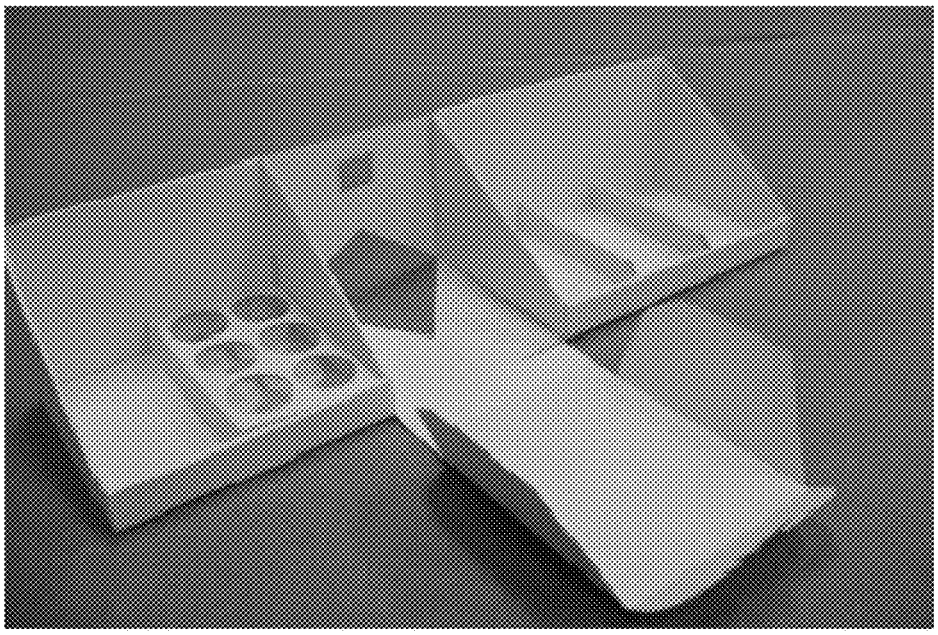
FIGS. 13(*a*) and 13(*b*) are front perspective views of an example of the shipping and display container according to embodiments of the invention.
Figure 13B:
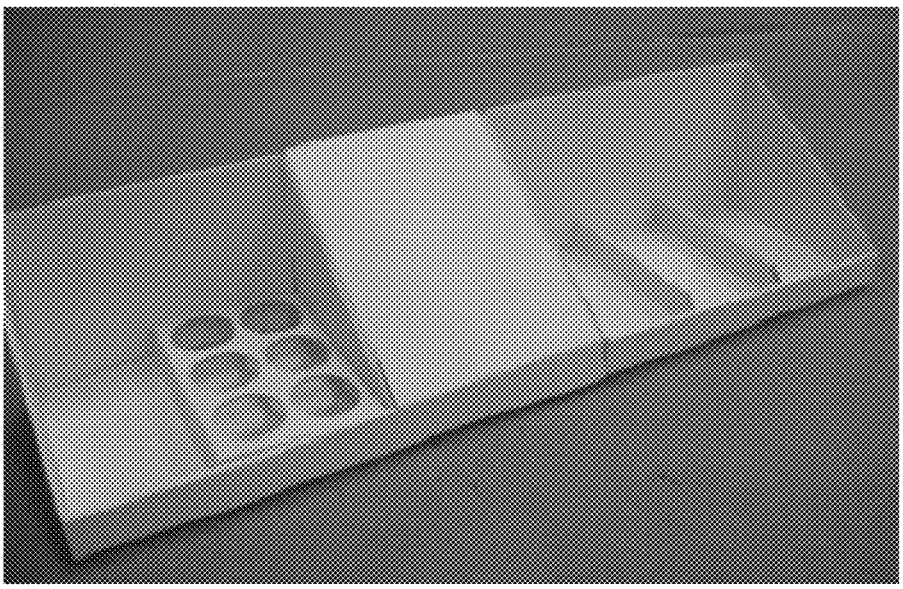

FIGS. 13A and 13B are also front perspective views of an example of the shipping and display container, according to the present invention, prior to adding products by the retailer or co-packer. As previously noted, the cover element (shown before being folded over the divider element in FIG. 13A and after being folded over the divider element in FIG. 13B) may be printed or laminated, for example, with customized advertising. The blank or sheet used to form the shipping and display container according to the embodiments described herein may be comprised of cardboard, corrugated paperboard, plastic sheets and other suitable materials.

While one or more example embodiments herein may relate to preloading a particular product, such as shaving cream or shaving gel and shaving blades, utilizing a particular product organizer element or a particular divider element, embodiments of the invention are not limited to such products, organizer elements, or divider elements. Thus, embodiments of the invention may be configured and dimensioned as a container for preloading, shipping and displaying any other product or products. Further, embodiments of the invention may be shipped without product or shipped with product that may be arranged or rearranged for display after shipping. It is to be further noted, that embodiments of the invention may also be configured and dimensioned in any number of different sizes for shipping and display with any number of tray elements. In addition, it is to be understood that a shipping and display container for embodiments of the invention may be shipped without a cover or enclosure or with any number of different types of covers or enclosures.

What is claimed is:

1. A shipping and display container, the container comprising:

a first tray element and a second tray element, each tray element having a tray element bottom panel and a tray element back panel, and each tray element having a tray element front panel at an acute angle with respect to the tray element bottom panel;

a bridge element disposed between the first and second tray elements, the bridge element having a first center bottom panel and a second center bottom panel, the first and second center bottom panels being accordion-foldable between a first position confronting one another and a second position extending in a common plane, and a first center back panel and a second center back panel, the first and second center back panels being accordion-foldable between a first position confronting one another and a second position extending in a common plane, the first and second center bottom panels being perpendicular to the first and second center back panels when both are in the second positions; and a cover element for covering a space between the first and second tray elements.

2. The shipping and display container of claim 1, wherein the first tray element, the second tray element, the bridge element and the cover element are interconnected as a single unit.

3. The shipping and display container of claim 1, wherein all of the elements are integrally formed in a single blank or sheet.

4. The shipping and display container of claim 3, wherein the single blank or sheet is a die-cut sheet.

5. The shipping and display container of claim 3, wherein the single blank or sheet is comprised of one of cardboard, corrugated paperboard and plastic sheets.

6. The shipping and display container of claim 1, wherein portions of the first tray element, the second tray element, the bridge element and the cover element are foldable so as to assemble the shipping and display container as a single unit.

7. The shipping and display container of claim 1, wherein the cover element includes customized information and graphics.

8. The shipping and display container of claim 1, further comprising a protector element.

9. The shipping and display container of claim 8 wherein the a protector element includes a plurality of openings.

10. The shipping and display container of claim 1, further comprising a divider element.

11. The shipping and display container of claim 10 further including a divider element divides the second tray element into three areas.

12. The shipping and display container of claim 1 wherein the acute angle is 45 degrees.

13. A method for making a shipping and display container, the method comprising:

providing a single sheet of material;

cutting the single sheet of material to include:

a first tray element and a second tray element, each tray element having a tray element bottom panel and a tray element back panel, and each tray element having a tray element front panel at an acute angle with respect to the tray element bottom panel;

a bridge element disposed between the first and second tray elements, the bridge element having a first center bottom panel and a second center bottom panel, the first and second center bottom panels being accordion-foldable between a first position confronting one another and a second position extending in a common plane, and having a first center back panel and a second center back panel, the first and second center back panels being accordion-foldable between a first position confronting one another and a second position extending in a common plane, wherein the common plane of the first and second center bottom panels is perpendicular to the common plane of the first and second center back panels; and a cover element for covering a space between the first and second tray elements, wherein the first tray element, the second tray element, the bridge element and the cover element include foldable portions; and wherein the first tray element, the second tray element, the bridge element and the cover element are included in the single sheet of material as interconnected pieces that form a single-unit shipping and display container.

14. The method of claim 13, further comprising folding the foldable portions of the first tray element, the second tray element, the bridge element and the cover element to form the single-unit shipping and display container.

15. The method of claim 13, wherein the single sheet of material comprises a single die-cut sheet.

16. A shipping and display container, the container comprising:

a first tray element and a second tray element, each tray element having a tray element bottom panel and a tray element back panel, and each tray element having a tray element front panel at an acute angle with respect to the tray element bottom panel;

a bridge element disposed between the first and second tray elements, the bridge element having a first center panel and a second center panel, the first and second center bottom panels being accordion-foldable between a first position confronting one another and a second position extending in a common plane;

a protector element in the first tray; and, a cover element for covering a space between the first and second tray elements.

* * * * *